US010031431B2

(12) United States Patent
Azuma et al.

(10) Patent No.: US 10,031,431 B2
(45) Date of Patent: Jul. 24, 2018

(54) ELECTROPHOTOGRAPHIC PHOTOSENSITIVE MEMBER

(71) Applicant: KYOCERA Document Solutions Inc., Osaka (JP)

(72) Inventors: Jun Azuma, Osaka (JP); Takahiro Oki, Osaka (JP); Kensuke Okawa, Osaka (JP); Akihiko Ogata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/492,914

(22) Filed: Apr. 20, 2017

(65) Prior Publication Data

US 2017/0307989 A1 Oct. 26, 2017

(30) Foreign Application Priority Data

Apr. 22, 2016 (JP) ..... 2016-085936

(51) Int. Cl.
*G03G 5/05* (2006.01)
*G03G 5/047* (2006.01)
(Continued)

(52) U.S. Cl.
CPC ..... *G03G 5/056* (2013.01); *G03G 5/047* (2013.01); *G03G 5/0517* (2013.01);
(Continued)

(58) Field of Classification Search
CPC ..... G03G 5/056; G03G 5/0614
See application file for complete search history.

(56) References Cited

U.S. PATENT DOCUMENTS 5,120,627 A * 6/1992 Nozomi ..... G03G 5/0525 427/74
5,780,194 A * 7/1998 Katsukawa ..... G03G 5/056 430/56
2007/0281227 A1* 12/2007 Maruo ..... G03G 5/047 430/58.05

FOREIGN PATENT DOCUMENTS

JP H10-288845 A 10/1998
JP 2002062671 A * 2/2002
JP 2006011307 A * 1/2006

OTHER PUBLICATIONS

English language machine translation of JP 2002-062671 (Feb. 2002).*

* cited by examiner

*Primary Examiner* — Christopher D Rodee
(74) *Attorney, Agent, or Firm* — Studebaker & Brackett PC

(57) ABSTRACT

An electrophotographic photosensitive member includes a conductive substrate and a photosensitive layer. The photosensitive layer contains at least a charge generating material, a charge transport material, and a binder resin. The binder resin includes a polyarylate resin. The polyarylate resin is represented by general formula (1) shown below. In general formula (1), X represents a divalent group represented by chemical formula (1-1), (1-2), (1-3), or (1-4) shown below.
(Continued)

(1)
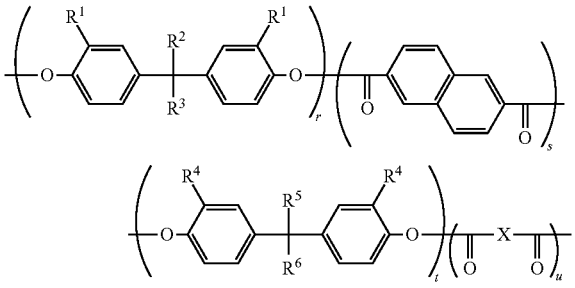
(1-1)
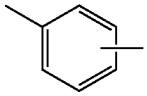
(1-2)
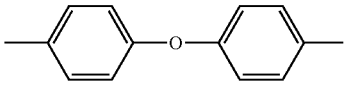
-continued
(1-3)
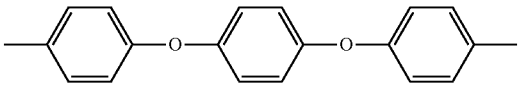
(1-4)
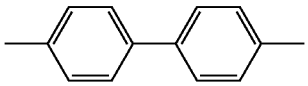
14 Claims, 2 Drawing Sheets
(51) Int. Cl.
*G03G 5/06* (2006.01)
*G03G 5/10* (2006.01)
*G03G 5/14* (2006.01)
(52) U.S. Cl.
CPC ..... *G03G 5/0525* (2013.01); *G03G 5/0542* (2013.01); *G03G 5/0614* (2013.01); *G03G 5/0696* (2013.01); *G03G 5/102* (2013.01); *G03G 5/144* (2013.01)

ELECTROPHOTOGRAPHIC PHOTOSENSITIVE MEMBER

INCORPORATION BY REFERENCE

The present application claims priority under 35 U.S.C. § 119 to Japanese Patent Application No. 2016-085936, filed on Apr. 22, 2016. The contents of this application are incorporated herein by reference in their entirety.

BACKGROUND

The present disclosure relates to an electrophotographic photosensitive member.

An electrophotographic image forming apparatus (for example, a printer or a multifunction peripheral) includes an electrophotographic photosensitive member as an image bearing member. The electrophotographic photosensitive member includes a photosensitive layer. Electrophotographic photosensitive members used in electrophotographic image forming apparatuses for example include single-layer electrophotographic photosensitive members and multi-layer electrophotographic photosensitive members. The single-layer electrophotographic photosensitive members each include a single-layer photosensitive layer having a charge generating function and a charge transport function. The multi-layer electrophotographic photosensitive members each include, as the photosensitive layer, a charge generating layer having a charge generating function and a charge transport layer having a charge transport function.

A polyarylate resin represented by chemical formula (Resin-A) (also referred to below as a polyarylate resin (Resin-A)) is known. A known electrophotographic photosensitive member contains the polyarylate resin (Resin-A).

(Resin-A)

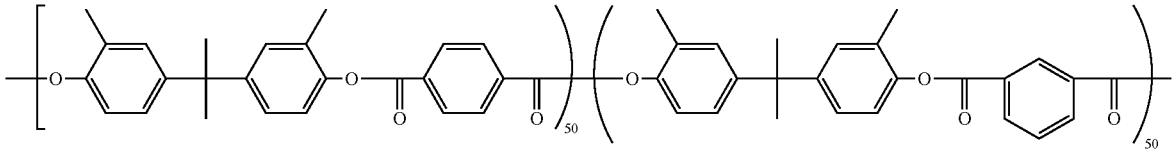

SUMMARY

An electrophotographic photosensitive member according to the present disclosure includes a conductive substrate and a photosensitive layer. The photosensitive layer contains at least a charge generating material, a charge transport material, and a binder resin. The binder resin includes a polyarylate resin. The polyarylate resin is represented by general formula (1) shown below.

(1)

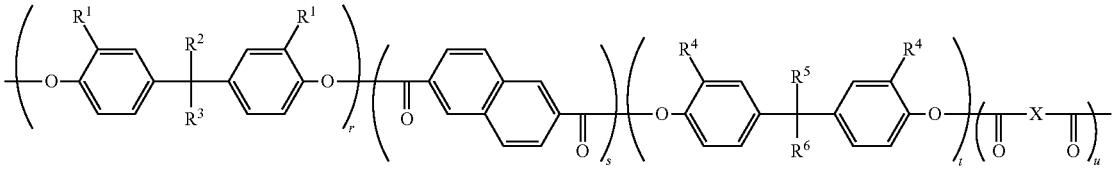

In general formula (1), $R^1$ represents a hydrogen atom or an alkyl group having a carbon number of at least 1 and no greater than 4. Two chemical groups $R^1$ may be the same or different to one another. $R^2$ and $R^3$ each represent, independently of one another, a hydrogen atom, an alkyl group having a carbon number of at least 1 and no greater than 4, or a phenyl group. $R^2$ and $R^3$ may be bonded to one another to form a ring, representing a cycloalkylidene group having a carbon number of at least 3 and no greater than 8. $R^4$ represents a hydrogen atom or an alkyl group having a carbon number of at least 1 and no greater than 4. Two chemical groups $R^4$ may be the same or different to one another. $R^5$ and $R^6$ each represent, independently of one another, a hydrogen atom, an alkyl group having a carbon number of at least 1 and no greater than 4, or a phenyl group. $R^5$ and $R^6$ are bonded to one another to form a ring, representing a cycloalkylidene group having a carbon number of at least 3 and no greater than 8. r and s each represent, independently of one another, a number greater than or equal to 1. t and u each represent, independently of one another, a number greater than or equal to 0. r+s+t+u=100. r+t=s+u. s/(s+u) is greater than 0.00 and no greater than 1.00. X represents a divalent group represented by chemical formula (1-1), (1-2), (1-3), or (1-4) shown below.

(1-1)

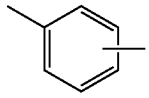

(1-2)

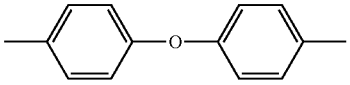

(1-3)

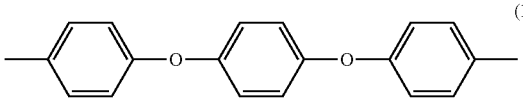

(1-4)

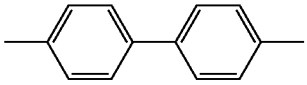

DETAILED DESCRIPTION

Figure 1A:
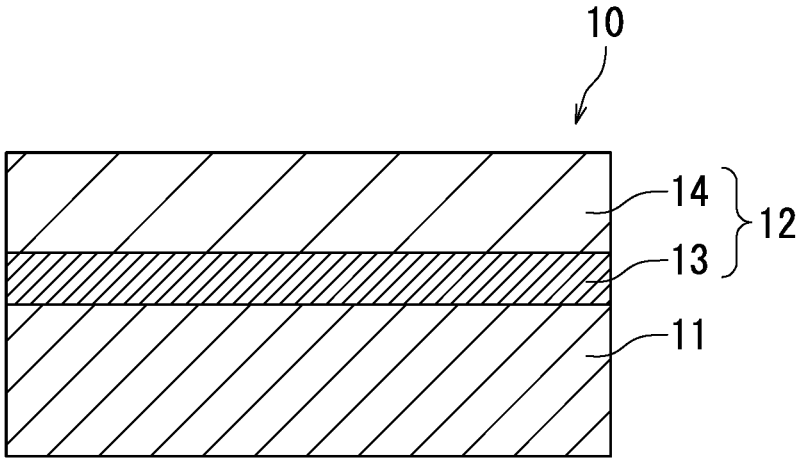
FIGS. 1A and 1B are partial cross-sectional views each illustrating a structure of an example of an electrophotographic photosensitive member according to an embodiment of the present disclosure.

The following describes an embodiment of the present disclosure in detail. However, the present disclosure is not in any way limited by the embodiment described below and appropriate variations may be made in practice within the intended scope of the present disclosure. Although description is omitted as appropriate in some instances in order to avoid repetition, such omission does not limit the essence of the present disclosure. In the present specification, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

Hereinafter, an alkyl group having a carbon number of at least 1 and no greater than 8, an alkyl group having a carbon number of at least 1 and no greater than 6, an alkyl group having a carbon number of at least 1 and no greater than 4, an alkyl group having a carbon number of at least 1 and no greater than 3, a cycloalkylidene group having a carbon number of at least 3 and no greater than 8, an alkoxy group having a carbon number of at least 1 and no greater than 8, and a cycloalkane having a carbon number of at least 5 and no greater than 7 each refer to the following.

An alkyl group having a carbon number of at least 1 and no greater than 8 as used herein refers to an unsubstituted straight chain or branched chain alkyl group. Examples of the alkyl group having a carbon number of at least 1 and no greater than 8 include a methyl group, an ethyl group, a propyl group, an isopropyl group, an n-butyl group, a sec-butyl group, a tert-butyl group, a pentyl group, an isopentyl group, a neopentyl group, a hexyl group, a heptyl group, and an octyl group.

An alkyl group having a carbon number of at least 1 and no greater than 6 used herein refers to an unsubstituted straight chain or branched chain alkyl group. Examples of the alkyl group having a carbon number of at least 1 and no greater than 6 include a methyl group, an ethyl group, a propyl group, an isopropyl group, an n-butyl group, a sec-butyl group, a tert-butyl group, a pentyl group, an isopentyl group, a neopentyl group, and a hexyl group.

An alkyl group having a carbon number of at least 1 and no greater than 4 used herein refers to an unsubstituted straight chain or branched chain alkyl group.

Examples of the alkyl group having a carbon number of at least 1 and no greater than 4 include a methyl group, an ethyl group, a propyl group, an isopropyl group, an n-butyl group, a sec-butyl group, and a tert-butyl group.

An alkyl group having a carbon number of at least 1 and no greater than 3 used herein refers to an unsubstituted straight chain or branched chain alkyl group. Examples of the alkyl group having a carbon number of at least 1 and no greater than 3 include a methyl group, an ethyl group, a propyl group, and an isopropyl group.

A cycloalkylidene group having a carbon number of at least 3 and no greater than 8 used herein refers to an unsubstituted cycloalkylidene group. Examples of the cycloalkylidene group having a carbon number of at least 3 and no greater than 8 include a cyclopropylidene group, a cyclobutylidene group, a cyclopentylidene group, a cyclohexylidene group, a cycloheptylidene group, and a cyclooctylidene group.

An alkoxy group having a carbon number of at least 1 and no greater than 8 used herein refers to an unsubstituted straight chain or branched chain alkoxy group. Examples of the alkoxy group having a carbon number of at least 1 and no greater than 8 include a methoxy group, an ethoxy group, an n-propoxy group, an isopropoxy group, an n-butoxy group, a sec-butoxy group, a tert-butoxy group, a pentyloxy group, an isopentyloxy group, a neopentyloxy group, a hexyloxy group, a heptyloxy group, and an octyloxy group.

A cycloalkane having a carbon number of at least 5 and no greater than 7 used herein refers to an unsubstituted cycloalkane. Examples of the cycloalkane having a carbon number of at least 5 and no greater than 7 include cyclopentane, cyclohexane, and cycloheptane.

<Photosensitive Member>

An electrophotographic photosensitive member (also referred to below as a photosensitive member) according to the present disclosure includes a conductive substrate and a photosensitive layer. The photosensitive member is for example a multi-layer electrophotographic photosensitive member (also referred to below as a multi-layer photosensitive member) or a single-layer electrophotographic photosensitive member (also referred to below as a single-layer photosensitive member). The term "photosensitive member" may be used herein as a generic term for both a multi-layer photosensitive member and a single-layer photosensitive member.

Figure 1B:
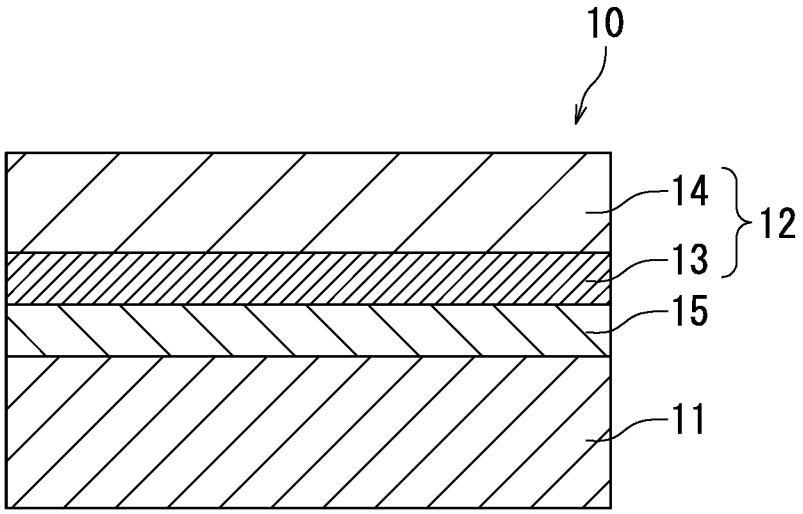

The photosensitive layer of the multi-layer photosensitive member includes a charge generating layer and a charge transport layer. The following describes a structure of the photosensitive member according to the present embodiment using an example in which the photosensitive member is a multi-layer photosensitive member 10 with reference to FIGS. 1A and 1B. FIGS. 1A and 1B are partial cross-sectional views each illustrating the structure of an example of the photosensitive member (multi-layer photosensitive member 10). As illustrated in FIG. 1A, the multi-layer photosensitive member 10 for example includes a conductive substrate 11 and a photosensitive layer 12. The photosensitive layer 12 includes a charge generating layer 13 and a charge transport layer 14. As illustrated in FIG. 1A, the charge transport layer 14 may be disposed as an outermost layer of the multi-layer photosensitive member 10. Abrasion resistance of the multi-layer photosensitive member 10 is easily improved by disposing, as an outermost layer, the charge transport layer 14 containing a polyarylate resin (1) to be described later. The charge transport layer 14 may be a monolayer (single-layer) charge transport layer.

The photosensitive layer 12 may be disposed directly on the conductive substrate 11 as illustrated in FIG. 1A. Alternatively, the multi-layer photosensitive member 10 may for example include the conductive substrate 11, an intermediate layer (undercoat layer) 15, and the photosensitive layer 12 as illustrated in FIG. 1B. The photosensitive layer 12 may be disposed indirectly on the conductive substrate 11 as illustrated in FIG. 1B. The intermediate layer 15 may be disposed between the conductive substrate 11 and the charge generating layer 13 as illustrated in FIG. 1B. The intermediate layer 15 may for example be disposed between the charge generating layer 13 and the charge transport layer 14. The charge generating layer 13 may be a single-layer charge generating layer or a multi-layer charge generating layer. Through the above, the structure of the multi-layer photosensitive member 10, which is an example of the photosensitive member according to the present embodiment, has been described with reference to FIGS. 1A and 1B.

Figure 2A:
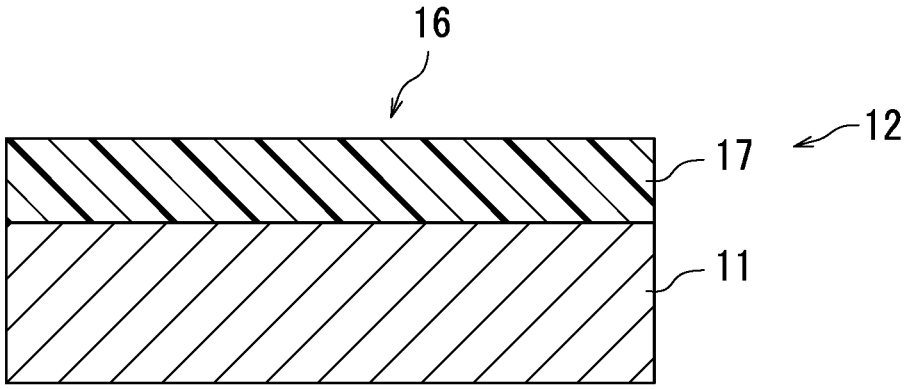
FIGS. 2A and 2B are partial cross-sectional views each illustrating a structure of another example of the electrophotographic photosensitive member according to the embodiment of the present disclosure.
Figure 2B:
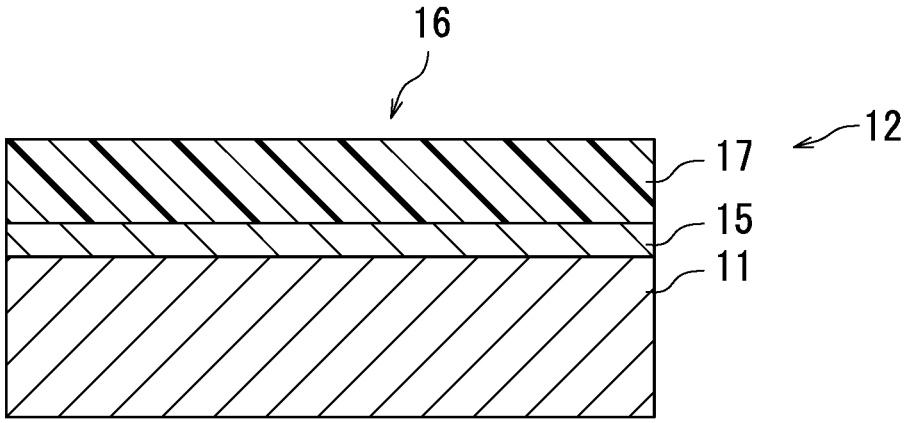

The following describes the single-layer photosensitive member. The single-layer photosensitive member includes a single-layer photosensitive layer. Like the multi-layer photosensitive member, the single-layer photosensitive member for example includes a conductive substrate and a photosensitive layer. The following describes a structure of the photosensitive member according to the present embodiment using an example in which the photosensitive member is a single-layer photosensitive member 16 with reference to FIGS. 2A and 2B. FIGS. 2A and 2B are partial cross-sectional views each illustrating the structure of another example of the photosensitive member (single-layer photosensitive member 16). As illustrated in FIG. 2A, the single-layer photosensitive member 16 for example includes the conductive substrate 11 and the photosensitive layer 12. The photosensitive layer 12 is a single-layer type photosensitive layer 17 (a single-layer photosensitive layer). As illustrated in FIG. 2A, the single-layer type photosensitive layer 17 may be disposed as an outermost layer of the single-layer photosensitive member 16. Abrasion resistance of the single-layer photosensitive member 16 is easily improved by disposing, as an outermost layer, the single-layer type photosensitive layer 17 containing the polyarylate resin (1) to be described later.

The single-layer type photosensitive layer 17, which is equivalent to the photosensitive layer 12, may be disposed directly on the conductive substrate 11 as illustrated in FIG. 2A. Alternatively, the single-layer photosensitive member 16 may for example include the conductive substrate 11, the intermediate layer (undercoat layer) 15, and the single-layer type photosensitive layer 17 as illustrated in FIG. 2B. The single-layer type photosensitive layer 17 may be disposed indirectly on the conductive substrate 11 as illustrated in FIG. 2B. The intermediate layer 15 may be disposed between the conductive substrate 11 and the photosensitive layer 12 as illustrated in FIG. 2B. Through the above, the structure of the single-layer photosensitive member 16, which is an example of the photosensitive member according to the present embodiment, has been described with reference to FIGS. 2A and 2B.

The photosensitive member according to the present embodiment has excellent abrasion resistance. The reason for the excellent abrasion resistance is thought to be as follows.

The photosensitive member according to the present embodiment contains a polyarylate resin as a binder resin. The polyarylate resin is represented by general formula (1) (hereinafter, such a polyarylate resin is referred to as a polyarylate resin (1)). The polyarylate resin (1) has a repeating unit represented by general formula (1-5) (also referred to below as a repeating unit (1-5)), a repeating unit represented by chemical formula (1-6) (also referred to below as a repeating unit (1-6)), a repeating unit represented by general formula (1-7) (also referred to below as a repeating unit (1-7)), and a repeating unit represented by general formula (1-8) (also referred to below as a repeating unit (1-8)).

(1-5)

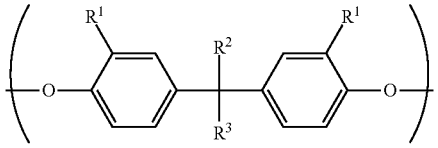

(1-6)

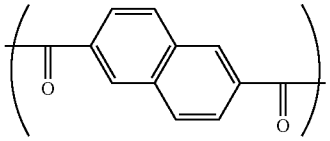

(1-7)

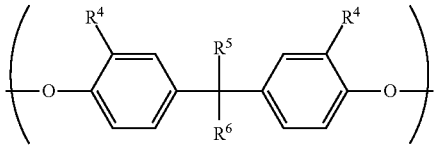

-continued (1-8)

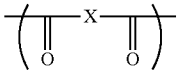

$R^1$, $R^2$, and $R^3$ in general formula (1-5) respectively represent the same as $R^1$, $R^2$, and $R^3$ in general formula (1). $R^4$, $R^5$, and $R^6$ in general formula (1-7) respectively represent the same as $R^4$, $R^5$, and $R^6$ in general formula (1). X in general formula (1-8) represents the same as X in general formula (1).

The polyarylate resin (1) has the repeating unit (1-6) including a naphthalene ring. The naphthalene ring has a π-conjugated system that spans a large spatial extent compared for example with a benzene ring, facilitating formation of a stacking structure. As a result, the photosensitive layer (charge transport layer) containing the polyarylate resin (1) tends to have an increased layer density. The photosensitive member according to the present embodiment therefore has excellent abrasion resistance.

The following describes elements (a conductive substrate, a photosensitive layer, and an intermediate layer) of the photosensitive member according to the present embodiment. The following further describes a method for producing the photosensitive member.

[1. Conductive Substrate]

No specific limitations are placed on the conductive substrate other than being a conductive substrate that can be used in the photosensitive member. The conductive substrate can be a conductive substrate of which at least a surface portion thereof is made from a conductive material. Examples of conductive substrates that can be used include: a conductive substrate formed from a conductive material; and a conductive substrate having a coat of a conductive material. Examples of conductive materials that can be used include aluminum, iron, copper, tin, platinum, silver, vanadium, molybdenum, chromium, cadmium, titanium, nickel, palladium, and indium. Any one of the conductive materials listed above may be used independently, or any two or more of the conductive materials listed above may be used in combination. Examples of combinations of two or more of the conductive materials include an alloy (specific examples include, an alloy such as stainless steel or brass).

Among the conductive materials listed above, aluminum or an aluminum alloy is preferable in terms of favorable charge mobility from the photosensitive layer to the conductive substrate.

The shape of the conductive substrate can be selected as appropriate in accordance with the structure of an image forming apparatus in which the conductive substrate is to be used. For example, a sheet-shaped conductive substrate or a drum-shaped conductive substrate can be used. The thickness of the conductive substrate can be selected as appropriate in accordance with the shape of the conductive substrate.

[2. Photosensitive Layer]

The photosensitive layer of the single-layer photosensitive member contains at least a charge generating material, a charge transport material, and a binder resin. The photosensitive layer may contain additives. No particular limitations are placed on thickness of the photosensitive layer so long as the thickness thereof is sufficient to enable the photosensitive layer to function as a photosensitive layer. More specifically, the photosensitive layer may have a thickness of at least 5 μm and no greater than 100 μm. Preferably, the photosensitive layer has a thickness of at least 10 μm and no greater than 50 μm.

The photosensitive layer of the multi-layer photosensitive member includes a charge generating layer and a charge transport layer. The photosensitive layer may contain additives. The charge generating layer contains at least a charge generating material. The charge transport layer contains at least a charge transport material and a binder resin. No particular limitations are placed on thickness of the charge generating layer so long as the thickness thereof is sufficient to enable the charge generating layer to function as a charge generating layer. More specifically, the charge generating layer preferably has a thickness of at least 0.01 μm and no greater than 5 μm, and more preferably at least 0.1 μm and no greater than 3 μm. No particular limitations are placed on thickness of the charge transport layer so long as the thickness thereof is sufficient to enable the charge transport layer to function as a charge transport layer. More specifically, the charge transport layer preferably has a thickness of at least 2 μm and no greater than 100 μm, and more preferably at least 5 μm and no greater than 50 μm.

[2-1. Common Elements of Configuration]

The following describes a charge generating material, a charge transport material, and a binder resin. The following further describes additives.

[2-1-1. Charge Generating Material]

No particular limitations are placed on the charge generating material other than being a charge generating material that can be used in the photosensitive member. Examples of charge generating materials that can be used include phthalocyanine-based pigments, perylene-based pigments, bisazo pigments, dithioketopyrrolopyrrole pigments, metal-free naphthalocyanine pigments, metal naphthalocyanine pigments, squaraine pigments, trisazo pigments, indigo pigments, azulenium pigments, cyanine pigments, powders of inorganic photoconductive materials such as selenium, selenium-tellurium, selenium-arsenic, cadmium sulfide, or amorphous silicon, pyrylium salts, anthanthrone-based pigments, triphenylmethane-based pigments, threne-based pigments, toluidine-based pigments, pyrazoline-based pigments, and quinacridone-based pigments. Examples of phthalocyanine-based pigments that can be used include phthalocyanine and phthalocyanine derivatives. Examples of phthalocyanine that can be used include metal-free phthalocyanine pigments (specific examples include X-form metal-free phthalocyanine (x-$H_2$Pc)). Examples of phthalocyanine derivatives that can be used include metal phthalocyanine pigments (specific examples include titanyl phthalocyanine and V-form hydroxygallium phthalocyanine). No particular limitations are placed on the crystal structure of the phthalocyanine-based pigment, and phthalocyanine-based pigments having various different crystal structures may be used. The phthalocyanine-based pigment for example has an α-form, a β-form, or a Y-form crystal structure. One charge generating material may be used independently, or two or more charge generating materials may be used in combination.

Any one charge generating material or a combination of two or more charge generating materials that is absorptive with respect to light in a desired wavelength region may be used. For example, in a digital optical image forming apparatus (for example, a laser beam printer or facsimile machine that uses a light source such as a semiconductor laser), a photosensitive member that is sensitive to a region of wavelengths of at least 700 nm is preferably used. Accordingly, for example, a phthalocyanine-based pigment is preferable, and Y-form titanyl phthalocyanine (Y-TiOPc)

is more preferable. The Y-form titanyl phthalocyanine may exhibit a main peak at a Bragg angle 2θ±0.2°=27.2° in a CuKα characteristic X-ray diffraction spectrum.

A photosensitive member included in an image forming apparatus that uses a short-wavelength laser light source (for example, a laser light source having an approximate wavelength of at least 350 nm and no greater than 550 nm) preferably contains an anthanthrone-based pigment or a perylene-based pigment as a charge generating material.

Examples of charge generating materials that can be used include phthalocyanine-based pigments represented by chemical formulae (CGM-1) to (CGM-4) (also referred to below as charge generating materials (CGM-1) to (CGM-4)).

(CGM-1)

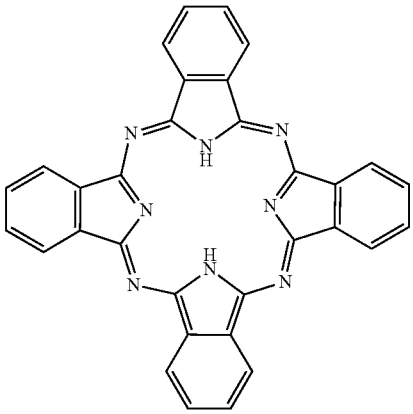

(CGM-2)

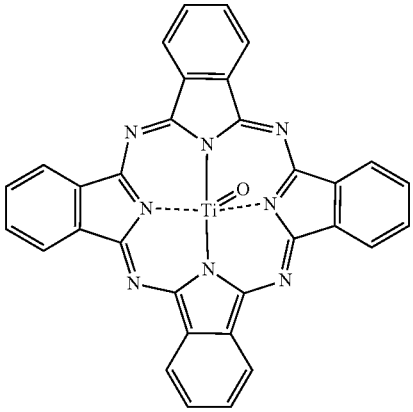

(CGM-3)

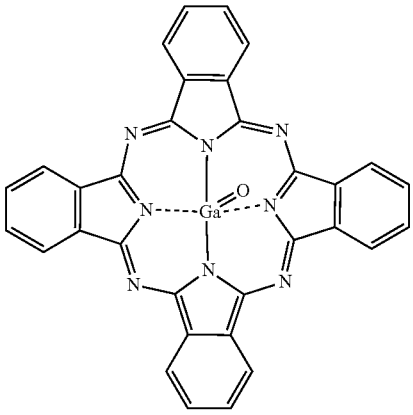

-continued (CGM-4)

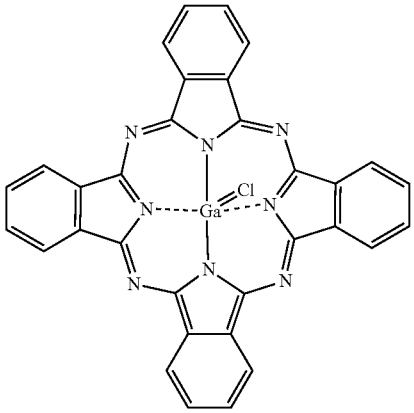

The charge generating material content is preferably at least 5 parts by mass and no greater than 1,000 parts by mass relative to 100 parts by mass of a binder resin for the charge generating layer (also referred to below as a base resin), and more preferably at least 30 parts by mass and no greater than 500 parts by mass.

[2-1-2. Charge Transport Material]

The charge transport material (in particular, hole transport material) preferably contains a compound including at least two styryl groups and at least one aryl groups. Examples of such hole transport materials include a compound represented by general formula (2), (3), or (4). As a result of the charge transport layer containing the compound represented by general formula (2), (3), or (4), abrasion resistance of the photosensitive member can be improved.

(2)

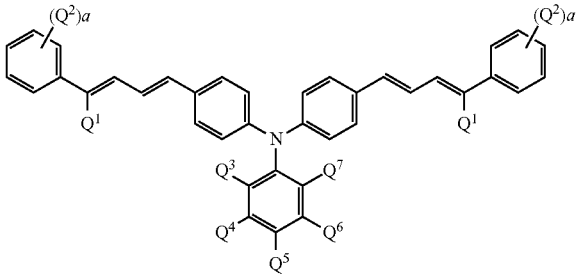

In general formula (2), $Q^1$ represents a hydrogen atom, an alkyl group having a carbon number of at least 1 and no greater than 8, an alkoxy group having a carbon number of at least 1 and no greater than 8, or a phenyl group optionally substituted with an alkyl group having a carbon number of at least 1 and no greater than 8. $Q^2$ represents an alkyl group having a carbon number of at least 1 and no greater than 8, an alkoxy group having a carbon number of at least 1 and no greater than 8, or a phenyl group. $Q^3$, $Q^4$, $Q^5$, $Q^6$, and $Q^7$ each represent, independently of one another, a hydrogen atom, an alkyl group having a carbon number of at least 1 and no greater than 8, an alkoxy group having a carbon number of at least 1 and no greater than 8, or a phenyl group. Adjacent two members among $Q^3$, $Q^4$, $Q^6$, and $Q^7$ may be bonded to one another to form a ring. a represents an integer of at least 0 and no greater than 5. When a represents an integer of at least 2 and no greater than 5, chemical groups $Q^2$ bonded to the same phenyl group may be the same or different to one another.

(3)

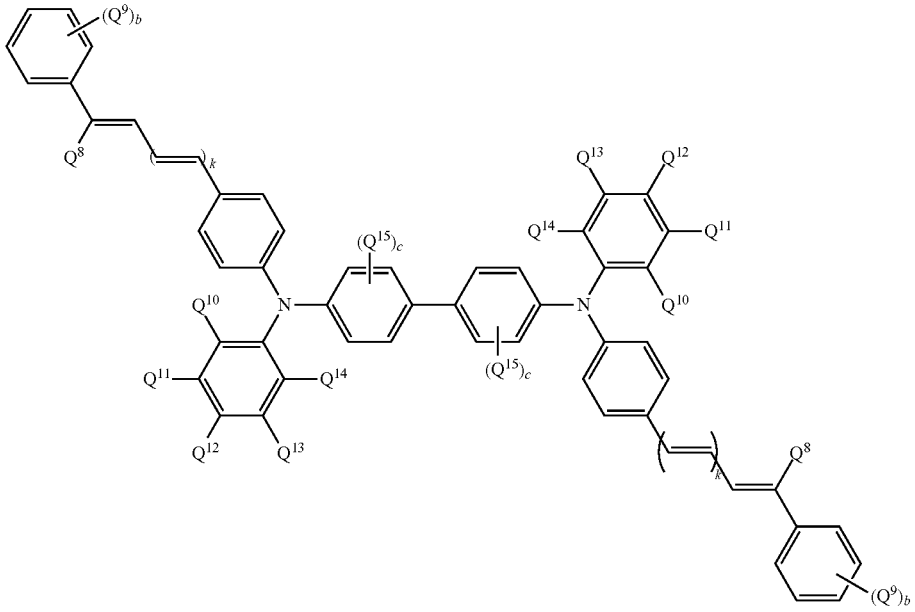

In general formula (3), $Q^8$, $Q^{10}$, $Q^{11}$, $Q^{12}$, $Q^{13}$, and $Q^{14}$ each represent, independently of one another, a hydrogen atom, an alkyl group having a carbon number of at least 1 and no greater than 8, an alkoxy group having a carbon number of at least 1 and no greater than 8, or a phenyl group. $Q^9$ and $Q^{15}$ each represent, independently of one another, an alkyl group having a carbon number of at least 1 and no greater than 8, an alkoxy group having a carbon number of at least 1 and no greater than 8, or a phenyl group. b represents an integer of at least 0 and no greater than 5. When b represents an integer of at least 2 and no greater than 5, chemical groups $Q^9$ bonded to the same phenyl group may be the same or different to one another. c represents an integer of at least 0 and no greater than 4. When c represents an integer of at least 2 and no greater than 4, chemical groups $Q^{15}$ bonded to the same phenylene group may be the same or different to one another. k represents 0 or 1.

(4)

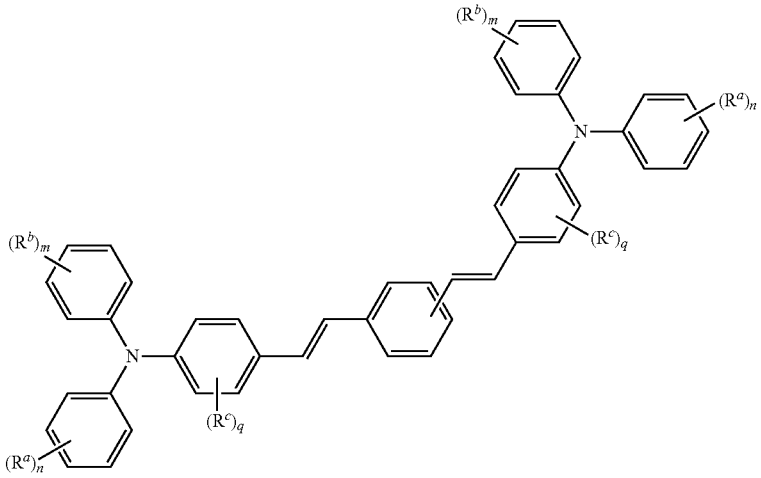

In general formula (4), $R^a$, $R^b$, and $R^c$ each represent, independently of one another, an alkyl group having a carbon number of at least 1 and no greater than 8, a phenyl group, or an alkoxy group having a carbon number of at least 1 and no greater than 8. q represents an integer of at least 0 and no greater than 4. When q represents an integer of at least 2 and no greater than 4, chemical groups $R^c$ bonded to the same phenylene group may be the same or different to one another. m and n each represent, independently of one another, an integer of at least 0 and no greater than 5. When m represents an integer of at least 2 and no greater than 5, chemical groups $R^b$ bonded to the same phenyl group may be the same or different to one another. When n represents an integer of at least 2 and no greater than 5, chemical groups $R^a$ bonded to the same phenyl group may be the same or different to one another.

In general formula (2), the phenyl group represented by $Q^1$ is preferably a phenyl group substituted with an alkyl group having a carbon number of at least 1 and no greater than 8, and more preferably a phenyl group substituted with a methyl group.

In general formula (2), the alkyl group having a carbon number of at least 1 and no greater than 8 represented by $Q^2$ is preferably an alkyl group having a carbon number of at least 1 and no greater than 6, more preferably an alkyl group having a carbon number of at least 1 and no greater than 4, and particularly preferably a methyl group. a preferably represents 0 or 1.

In general formula (2), the alkyl group having a carbon number of at least 1 and no greater than 8 represented by any of $Q^3$ to $Q^7$ is preferably an alkyl group having a carbon number of at least 1 and no greater than 4, and more preferably a methyl group, an ethyl group, or an n-butyl group. In general formula (2), the alkoxy group having a carbon number of at least 1 and no greater than 8 represented by any of $Q^3$ to $Q^7$ is preferably a methoxy group. In general formula (2), $Q^3$ to $Q^7$ preferably each represent, independently of one another, a hydrogen atom, an alkyl group having a carbon number of at least 1 and no greater than 8, or an alkoxy group having a carbon number of at least 1 and no greater than 8, and more preferably a hydrogen atom, an alkyl group having a carbon number of at least 1 and no greater than 4, or a methoxy group.

In general formula (2), adjacent two members among $Q^3$ to $Q^7$ may be bonded to one another to form a ring (more specifically, a benzene ring or a cycloalkane having a carbon number of at least 5 and no greater than 7). For example, adjacent $Q^6$ and $Q^7$ among $Q^3$ to $Q^7$ may be bonded to one another to form a benzene ring or a cycloalkane having a carbon number of at least 5 and no greater than 7. When two adjacent members among $Q^3$ to $Q^7$ are bonded to one another to form a benzene ring, the benzene ring is fused with the phenyl group to which $Q^3$ to $Q^7$ are bonded, to form a fused bicyclic group (naphthyl group). When two adjacent members among $Q^3$ to $Q^7$ are bonded to one another to form a cycloalkane having a carbon number of at least 5 and no greater than 7, the cycloalkane having a carbon number of at least 5 and no greater than 7 is fused with the phenyl group to which $Q^3$ to $Q^7$ are bonded, to form a fused bicyclic group. In such a case, the fused position between the phenyl group and the cycloalkane having a carbon number of at least 5 and no greater than 7 may include a double bond. Preferably, two adjacent members among $Q^3$ to $Q^7$ are bonded to one another to form a cycloalkane having a carbon number of at least 5 and no greater than 7. More preferably, two adjacent members among $Q^3$ to $Q^7$ are bonded to one another to form cyclohexane.

In general formula (2), $Q^1$ preferably represents a hydrogen atom or a phenyl group substituted with an alkyl group having a carbon number of at least 1 and no greater than 4. $Q^2$ preferably represents an alkyl group having a carbon number of at least 1 and no greater than 4. $Q^3$ to $Q^7$ preferably each represent, independently of one another, a hydrogen atom, an alkyl group having a carbon number of at least 1 and no greater than 4, or an alkoxy group having a carbon number of at least 1 and no greater than 4. Two adjacent members among $Q^3$ to $Q^7$ may be bonded to one another to represent a ring. a preferably represents 0 or 1.

In general formula (3), the alkyl group having a carbon number of at least 1 and no greater than 8 represented by any of $Q^8$ and $Q^{10}$ to $Q^{14}$ is preferably an alkyl group having a carbon number of at least 1 and no greater than 4, and more preferably a methyl group or an ethyl group. In general formula (3), $Q^8$ and $Q^{10}$ to $Q^{14}$ preferably each represent, independently of one another, a hydrogen atom, an alkyl group having a carbon number of at least 1 and no greater than 4, or a phenyl group, and b and c preferably each represent 0.

In particular, abrasion resistance of the photosensitive member can be further improved through the photosensitive layer thereof including the polyarylate resin (1) as a binder resin and including, as a charge transport material, the compound represented by general formula (3) wherein $Q^8$, and $Q^{10}$ to $Q^{14}$ each represent, independently of one another, a hydrogen atom or an alkyl group having a carbon number of at least 1 and no greater than 4, and b and c each represent 0.

In general formula (4), the alkyl group having a carbon number of at least 1 and no greater than 8 represented by any of $R^a$ and $R^b$ is preferably an alkyl group having a carbon number of at least 1 and no greater than 4, and more preferably a methyl group or an ethyl group. Preferably, in general formula (4), $R^a$ and $R^b$ each represent, independently of one another, an alkyl group having a carbon number of at least 1 and no greater than 4, m and n each represent, independently of one another, an integer of at least 0 and no greater than 2, and q represents 0.

More specifically, the hole transport material is any of charge transport materials represented by chemical formulae (CTM-1) to (CTM-9) (also referred to below as charge transport materials (CTM-1) to (CTM-9)). Note that the charge transport materials (CTM-1) to (CTM-4) are specific examples of the compound represented by general formula (2). The charge transport materials (CTM-5) to (CTM-7) are specific examples of the compound represented by general formula (3). The charge transport materials (CTM-8) to (CTM-9) are specific examples of the compound represented by general formula (4).

(CTM-1)
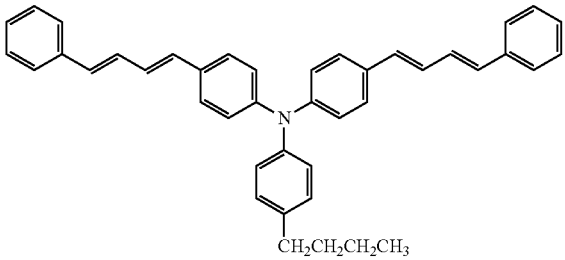
(CTM-2)
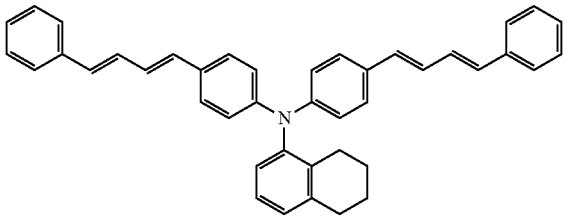
(CTM-3)
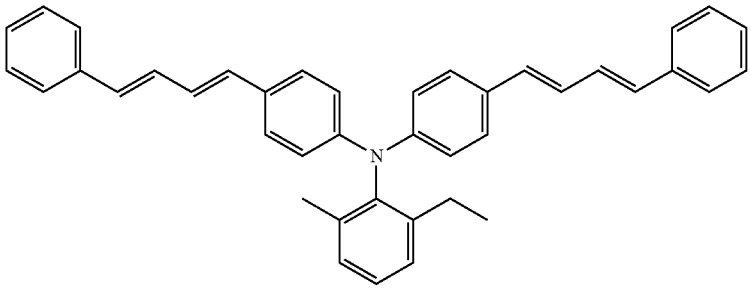
(CTM-4)
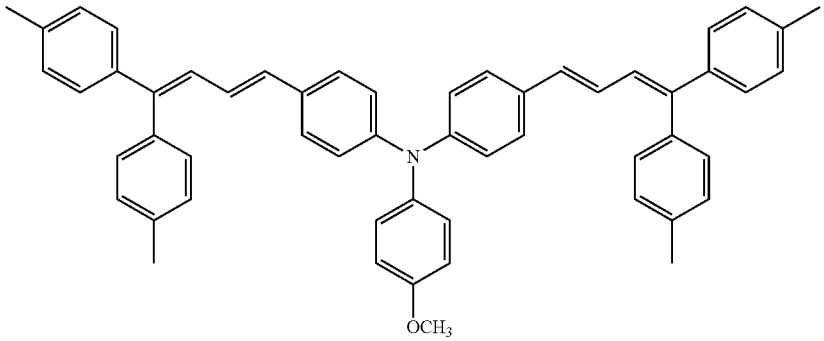
(CTM-5)
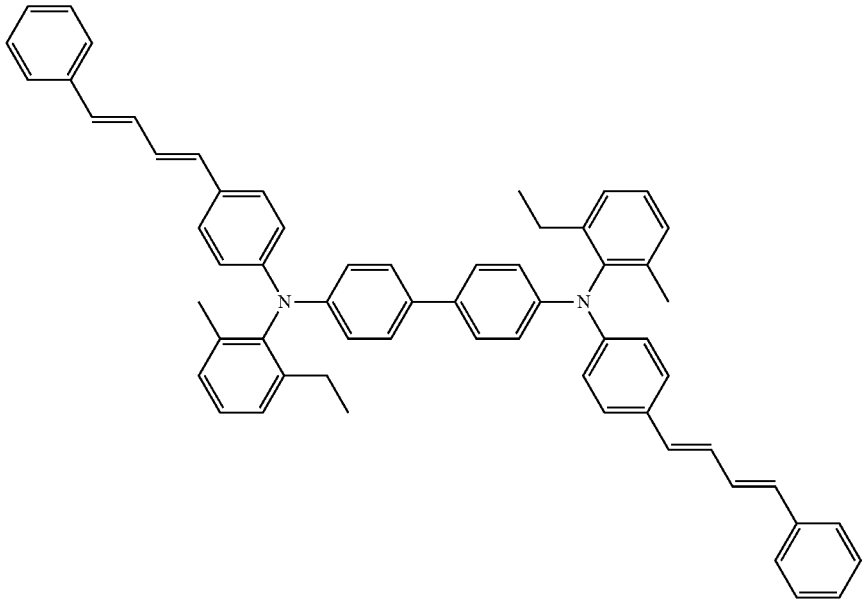

-continued (CTM-6)

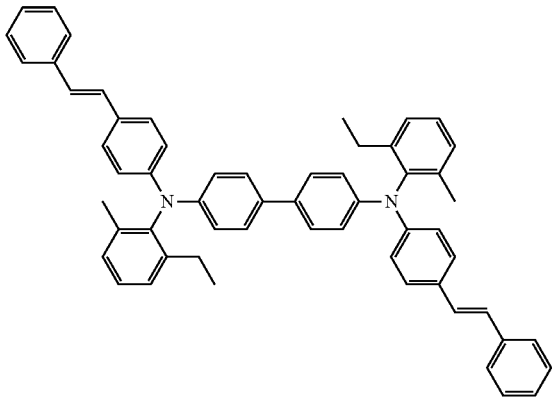

(CTM-7)

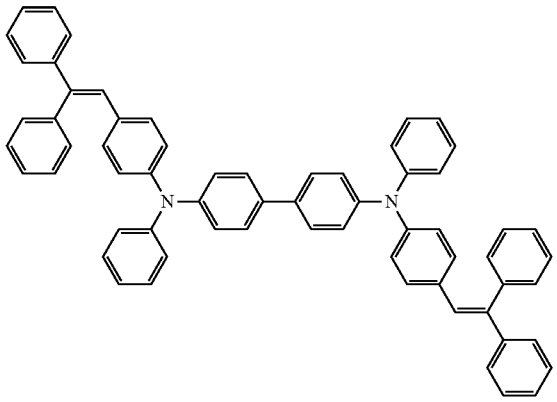

(CTM-8)

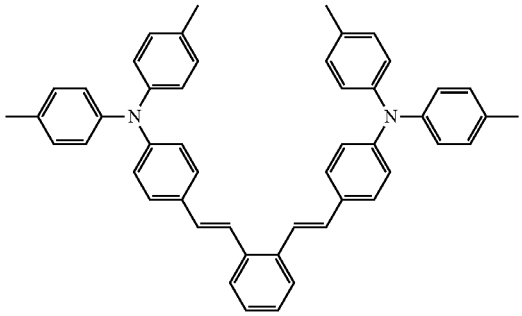

(CTM-9)

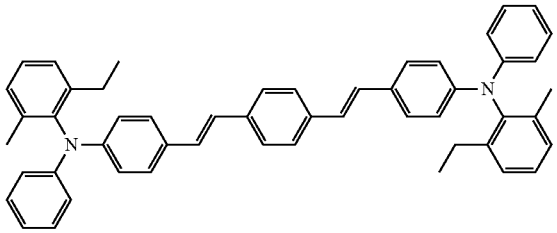

The hole transport material may contain a compound other than the compound represented by general formula (2), (3), or (4). Examples of the aforementioned hole transport material include nitrogen containing cyclic compounds and condensed polycyclic compounds. Examples of nitrogen-containing cyclic compounds and condensed polycyclic compounds that can be used include diamine derivatives (specific examples include —N,N,N',N'-tetraphenylphenylenediamine derivatives, N,N,N',N'-tetraphenylnaphtylenediamine derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds.

The amount of the hole transport material contained in the multi-layer photosensitive member is preferably at least 10 parts by mass and no greater than 200 parts by mass relative to 100 parts by mass of the binder resin, and more preferably no less than 20 parts by mass and no greater than 100 parts by mass.

[2-1-3. Binder Resin]

The charge transport layer of the multi-layer photosensitive member or the photosensitive layer of the single-layer photosensitive member contains a binder resin. The binder resin includes the polyarylate resin (1). The polyarylate resin (1) is represented by general formula (1). As a result of the photosensitive layer of the photosensitive member containing the polyarylate resin (1), abrasion resistance of the photosensitive member is improved.

(1)

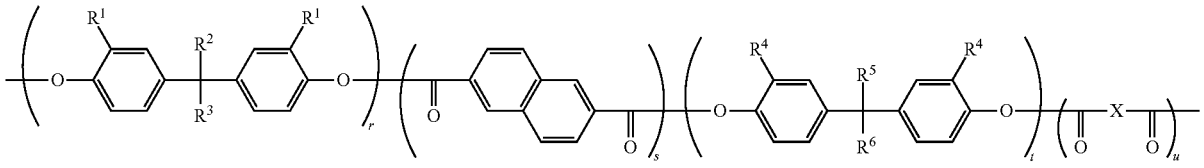

In general formula (1), $R^1$ represents a hydrogen atom or an alkyl group having a carbon number of at least 1 and no greater than 4. The two chemical groups $R^1$ may be the same or different to one another. $R^2$ and $R^3$ each represent, independently of one another, a hydrogen atom, an alkyl group having a carbon number of at least 1 and no greater than 4, or a phenyl group. $R^2$ and $R^3$ may be bonded to one another to form a ring, representing a cycloalkylidene group having a carbon number of at least 3 and no greater than 8. $R^4$ represents a hydrogen atom or an alkyl group having a carbon number of at least 1 and no greater than 4. The two chemical groups $R^4$ may be the same or different to one another. $R^5$ and $R^6$ each represent, independently of one another, a hydrogen atom, an alkyl group having a carbon number of at least 1 and no greater than 4, or a phenyl group. $R^5$ and $R^6$ are bonded to one another to form a ring, representing a cycloalkylidene group having a carbon number of at least 3 and no greater than 8. r and s each represent, independently of one another, a number greater than or equal to 1. t and u each represent, independently of one another, a number greater than or equal to 0. r+s+t+u=100. r+t=s+u. s/(s+u) is greater than 0.00 and no greater than 1.00. X represents a divalent group represented by chemical formula (1-1), (1-2), (1-3), or (1-4).

(1-1)

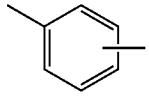

(1-2)

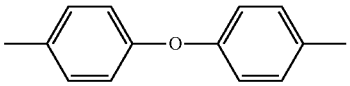

(1-3)

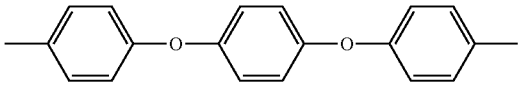

(1-4)

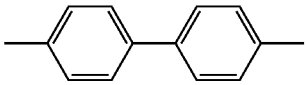

In general formula (1), the phenyl group represented by any of $R^2$ and $R^3$ may be a phenyl group substituted with an alkyl group having a carbon number of at least 1 and no greater than 4.

In general formula (1), the phenyl group represented by any of $R^5$ and $R^6$ may be a phenyl group substituted with an alkyl group having a carbon number of at least 1 and no greater than 4.

As described above, the polyarylate resin (1) has the repeating unit (1-5), the repeating unit (1-6), the repeating unit (1-7), and the repeating unit (1-8).

(1-5)

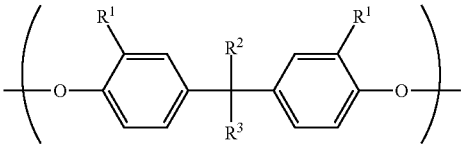

(1-6)

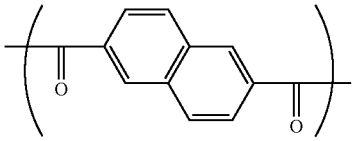

-continued (1-7)

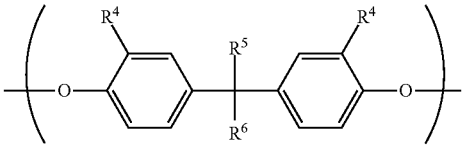

(1-8)

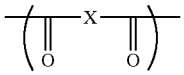

The repeating unit (1-5) and the repeating unit (1-7) in the polyarylate resin (1) may be the same or different to one another.

When the repeating unit (1-5) and the repeating unit (1-7) in the polyarylate resin (1) are the same as one another, the two chemical groups $R^1$ in general formula (1) are the same as one another, and the two chemical groups $R^4$ are the same as one another. In this case, in general formula (1), $R^1$ and $R^4$ are the same as one another, $R^2$ and $R^5$ are the same as one another, and $R^3$ and $R^6$ are the same as one another.

When the repeating unit (1-5) and the repeating unit (1-7) in the polyarylate resin (1) are different from one another, chemical groups are different from one another in at least one of a combination of $R^1$ and $R^4$, a combination of $R^2$ and $R^5$, and a combination of $R^3$ and $R^6$. That is, $R^1$, $R^2$, $R^3$, $R^4$, $R^5$, and $R^6$ each represent a chemical group which satisfies at least one of a first condition that $R^1$ and $R^4$ are different from one another, a second condition that $R^2$ and $R^5$ are different from one another, and a third condition that $R^3$ and $R^6$ are different from one another. For example, chemical groups are different from one another in one of the combination of $R^1$ and $R^4$, the combination of $R^2$ and $R^5$, and the combination of $R^3$ and $R^6$, and chemical groups are the same as one another in each of the other two combinations. That is, $R^1$, $R^2$, $R^3$, $R^4$, $R^5$, and $R^6$ may each represent a chemical group which satisfies one of the first condition, the second condition, and the third condition, and which does not satisfy the other two conditions. For another example, chemical groups are different from one another in each of two combinations of the combination of $R^1$ and $R^4$, the combination of $R^2$ and $R^5$, and the combination of $R^3$ and $R^6$, and chemical groups are the same as one another in the other one combination. That is, $R^1$, $R^2$, $R^3$, $R^4$, $R^5$ and $R^6$ may each represent a chemical group which satisfies two of the first condition, the second condition, and the third condition, and which does not satisfy the other one condition. For another example, chemical groups are different from one another in each of the three combinations of $R^1$ and $R^4$, $R^2$ and $R^5$, and $R^3$ and $R^6$. That is, $R^1$, $R^2$, $R^3$, $R^4$, $R^5$, and $R^6$ may each represent a chemical group which satisfies all the three of the first condition, the second condition, and the third condition. When the repeating unit (1-5) and the repeating unit (1-7) in the polyarylate resin (1) are different from one another, the two chemical groups $R^1$ in general formula (1) are preferably the same as one another, and the two chemical groups $R^4$ are preferably also the same as one another. More preferably, $R^1$ and $R^4$ are different from one another, $R^2$ and $R^5$ are the same as one another, and $R^3$ and $R^6$ are different from one another.

When the repeating unit (1-5) and the repeating unit (1-7) are the same as one another, the polyarylate resin (1) preferably has the following constitution.

That is, $R^1$ and $R^4$ in general formula (1) preferably each represent a hydrogen atom. Alternatively, $R^1$ and $R^4$ in general formula (1) preferably each represent a methyl group. Preferably, in general formula (1), $R^2$ and $R^5$ each represent a methyl group, and $R^3$ and $R^6$ each represent an alkyl group having a carbon number of at least 1 and no greater than 3. Alternatively, in general formula (1), $R^2$ and $R^3$ are preferably bonded to one another to form a ring, representing a cyclohexylidene group, and $R^5$ and $R^6$ are preferably bonded to one another to form a ring, representing a cyclohexylidene group.

Particularly preferably, in terms of increasing the effect of improving abrasion resistance of the photosensitive member, $R^2$ and $R^5$ each represent a methyl group, $R^3$ and $R^6$ each represent an ethyl group, and X represents a divalent group represented by chemical formula (1-1) in general formula (1). Examples of the polyarylate resin (1) such as described above include polyarylate resins represented by chemical formulae (Resin-2) and (Resin-3) to be described later. Particularly preferably, in terms of further increasing the effect of improving abrasion resistance of the photosensitive member, $R^1$ and $R^4$ each represent a hydrogen atom, $R^2$ and $R^5$ each represent a methyl group, $R^3$ and $R^6$ each represent an ethyl group, and X represents a divalent group represented by chemical formula (1-1) in general formula (1). Examples of the polyarylate resin (1) such as described above include the polyarylate resin represented by chemical formula (Resin-2) to be described later.

Still more preferably, in terms of increasing the effect of improving abrasion resistance of the photosensitive member, $R^2$, $R^3$, $R^5$, and $R^6$ each represent a methyl group, and X represents a divalent group represented by chemical formula (1-1) in general formula (1). Examples of the polyarylate resin (1) such as described above include polyarylate resins represented by chemical formulae (Resin-1), (Resin-10), and (Resin-11) to be described later. Particularly preferably, in terms of further increasing the effect of improving abrasion resistance of the photosensitive member, $R^2$, $R^3$, $R^5$, and $R^6$ each represent a methyl group, X represents a divalent group represented by chemical formula (1-1), and s/(s+u) is greater than 0.50 and no greater than 0.80 (preferably, at least 0.60 and no greater than 0.80) in general formula (1). Examples of the polyarylate resin (1) such as described above include the polyarylate resin represented by chemical formula (Resin-11) to be described later.

When X represents a divalent group represented by chemical formula (1-1), no particular limitations are placed on the bonding position of the methylene bond to the benzene ring. The divalent group represented by chemical formula (1-1) is for example a divalent group represented by chemical formula (1-1-1), (1-1-2), or (1-1-3) shown below. X preferably represents a divalent group represented by chemical formula (1-1-2).

(1-1-1)

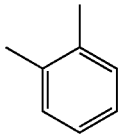

(1-1-2)

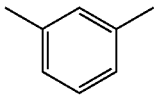

-continued (1-1-3)

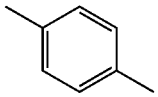

Particularly preferably, in terms of increasing the effect of improving electrical characteristics (in particular, sensitivity characteristics) of the photosensitive member, $R^2$ and $R^5$ each represent a methyl group, and X represents a divalent group represented by chemical formula (1-2) in general formula (1). Examples of the polyarylate resin (1) such as described above include polyarylate resins represented by chemical formulae (Resin-6) and (Resin-7) to be described later. Particularly preferably, in terms of increasing the effect of improving electrical characteristics (in particular, sensitivity characteristics) of the photosensitive member, $R^1$ and $R^4$ each represent a methyl group, $R^2$ and $R^5$ each represent a methyl group, and X represents a divalent group represented by chemical formula (1-2) in general formula (1). Examples of the polyarylate resin (1) such as described above include the polyarylate resin represented by chemical formula (Resin-7) to be described later.

The polyarylate resin (1) may only have the repeating units (1-5) to (1-8) as repeating units thereof. Alternatively, the polyarylate resin (1) may have a repeating unit other than the repeating units (1-5) to (1-8) in addition to the repeating units (1-5) to (1-8) as a repeating unit thereof. A ratio (mole fraction) of the total amount by mole of the repeating units (1-5) to (1-8) relative to the total amount by mole of the repeating units included in the polyarylate resin (1) is preferably at least 0.8, more preferably at least 0.9, and particularly preferably 1.0.

No particular limitations are placed on the sequence of the repeating units (1-5) to (1-8) in the polyarylate resin (1) so long as a repeating unit derived from an aromatic diol and a repeating unit derived from an aromatic dicarboxylic acid are adjacent to one another. For example, the repeating unit (1-5) is adjacent to and bonded to the repeating unit (1-6) or the repeating unit (1-8). Likewise, the repeating unit (1-7) is adjacent to and bonded to the repeating unit (1-6) or the repeating unit (1-8).

In general formula (1), r and s each represent, independently of one another, a number greater than or equal to 1. r and s preferably each represent, independently of one another, a number greater than or equal to 1 and less than or equal to 50, more preferably a number greater than or equal to 5 and less than or equal to 45, and particularly preferably a number greater than or equal to 10 and less than or equal to 40. t and u each represent, independently of one another, a number greater than or equal to 0. t and u preferably each represent, independently of one another, a number greater than or equal to 0 and less than or equal to 49, more preferably a number greater than or equal to 5 and less than or equal to 45, and particularly preferably a number greater than or equal to 10 and less than or equal to 40. r and s may each represent, independently of one another, an integer of at least 1. t and u may each represent, independently of one another, an integer of at least 0.

In general formula (1), r+s+t+u=100. r in general formula (1) represents a percentage of the number of repeating units (1-5) relative to a sum of the number of repeating units (1-5), the number of repeating units (1-6), the number of repeating units (1-7), and the number of repeating units (1-8) (also referred to below as "a repeating unit (1-5) percentage"). s in general formula (1) represents a percentage of the number of repeating units (1-6) relative to a sum of the number of repeating units (1-5), the number of repeating units (1-6), the number of repeating units (1-7), and the number of repeating units (1-8) (also referred to below as "a repeating unit (1-6) percentage"). t in general formula (1) represents a percentage of the number of repeating units (1-7) relative to a sum of the number of repeating units (1-5), the number of repeating units (1-6), the number of repeating units (1-7), and the number of repeating units (1-8) (also referred to below as "a repeating unit (1-7) percentage"). u in general formula (1) represents a percentage of the number of repeating units (1-8) relative to a sum of the number of repeating units (1-5), the number of repeating units (1-6), the number of repeating units (1-7), and the number of repeating units (1-8) (also referred to below as "a repeating unit (1-8) percentage").

In general formula (1), r+t=s+u. When r+t=s+u, a sum of the repeating unit (1-5) percentage and the repeating unit (1-7) percentage is equal to a sum of the repeating unit (1-6) percentage and the repeating unit (1-8) percentage. This means that the amount of the aromatic diol-derived repeating units contained in the polyarylate resin (1) is equal to the amount of the aromatic dicarboxylic acid-derived repeating units contained in the polyarylate resin (1). The aromatic diol-derived repeating units are the repeating unit (1-5) and the repeating unit (1-7). The aromatic dicarboxylic acid-derived repeating units are the repeating unit (1-6) and the repeating unit (1-8).

In general formula (1), s/(s+u) is greater than 0.00 and no greater than 1.00, preferably at least 0.02 and no greater than 1.00, more preferably at least 0.10 and no greater than 0.90, still more preferably at least 0.20 and no greater than 0.80, even more preferably greater than 0.50 and no greater than 0.80, and particularly preferably at least 0.60 and no greater than 0.80. s/(s+u) represents a ratio of the repeating unit (1-6) percentage relative to a sum of the repeating unit (1-6) percentage and the repeating unit (1-8) percentage. In other words, s/(s+u) represents a ratio (mole fraction) of the amount by mole of the repeating unit (1-6) relative to the total amount by mole of the repeating unit (1-6) and the repeating unit (1-8) in the polyarylate resin (1). When s/(s+u) is 0.00, abrasion resistance of the photosensitive member is not improved. As a result of s/(s+u) being no greater than 1.00, the polyarylate resin (1) is easily dissolved in a solvent for formation of the photosensitive layer. When s/(s+u) is 1.00, u is 0.00. When s/(s+u) is 1.00, the polyarylate resin (1) does not have the repeating unit (1-8).

Preferably, in general formula (1), r and s each represent, independently of one another, a number greater than or equal to 1 and less than or equal to 50, t and u each represent, independently of one another, a number greater than or equal to 0 and less than or equal to 49, and s/(s+u) is at least 0.02 and no greater than 1.00.

In general formula (1), r+s is preferably at least 26 and no greater than 100, more preferably at least 30 and no greater than 70, and particularly preferably at least 30 and no greater than 60. When r+s is 100, t is 0, and u is 0. When r+s is 100, the polyarylate resin (1) does not have the repeating unit (1-7) or (1-8). When r+s is 100, the polyarylate resin (1) only has the repeating units (1-5) and (1-6).

Examples of the polyarylate resin (1) include polyarylate resins represented by chemical formulae (Resin-1) to (Resin-14) (also referred to below as polyarylate resins (Resin-1) to (Resin-14)).

(Resin-1)

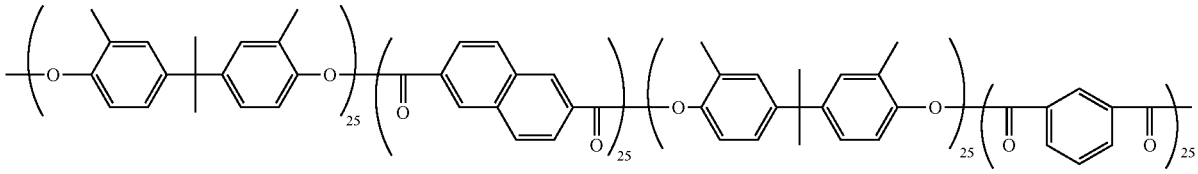

(Resin-2)

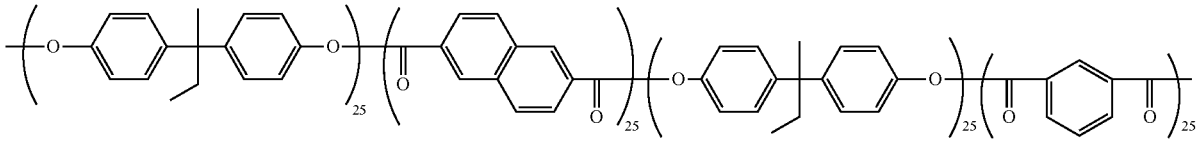

(Resin-3)

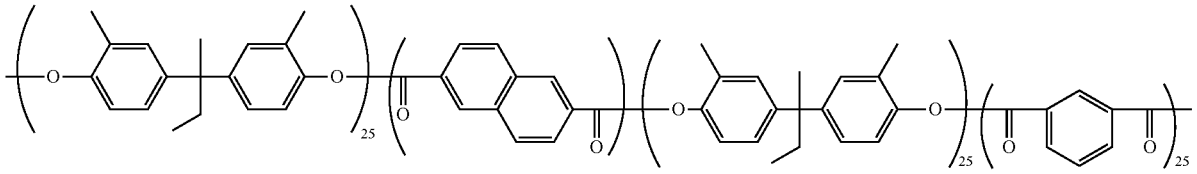

(Resin-4)

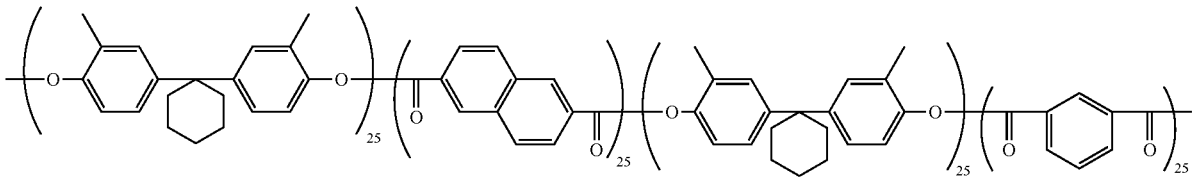

-continued
(Resin-5)
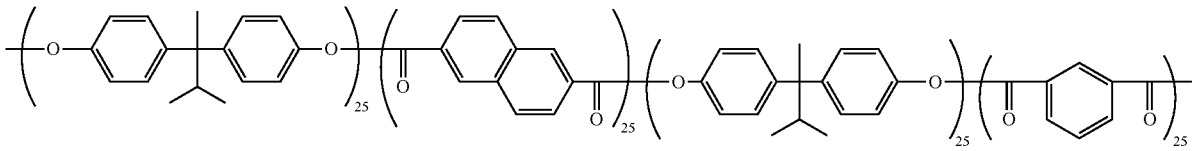
(Resin-6)
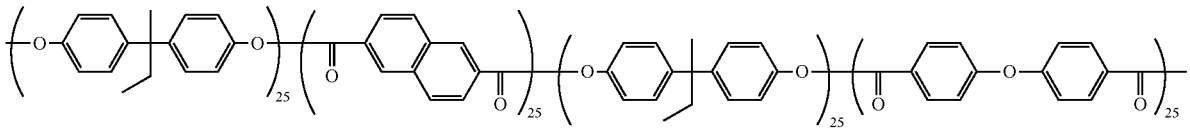
(Resin-7)
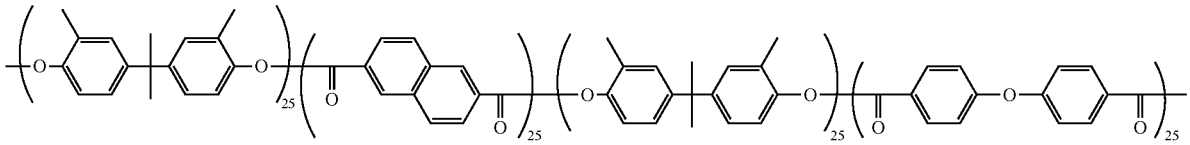
(Resin-8)
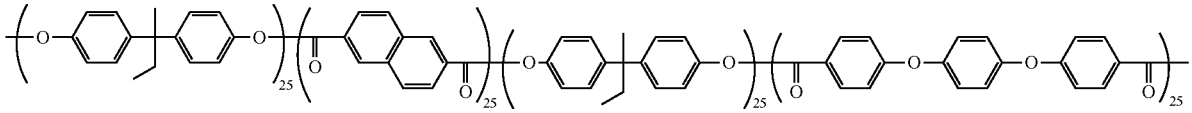
(Resin-9)
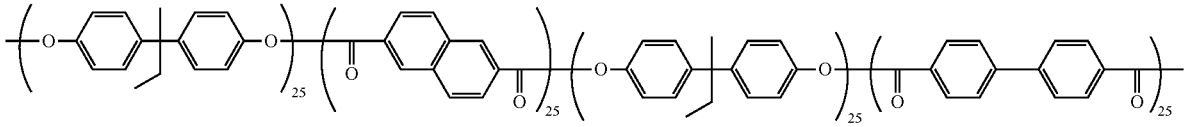
(Resin-10)
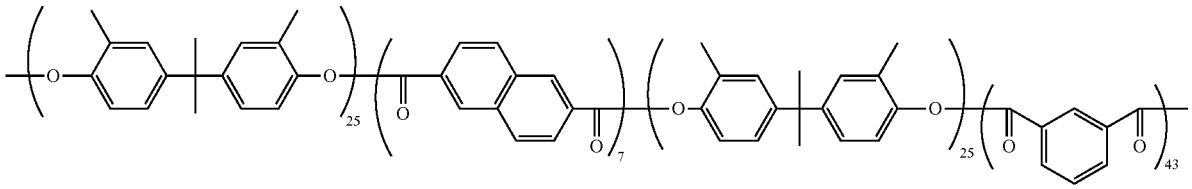
(Resin-11)
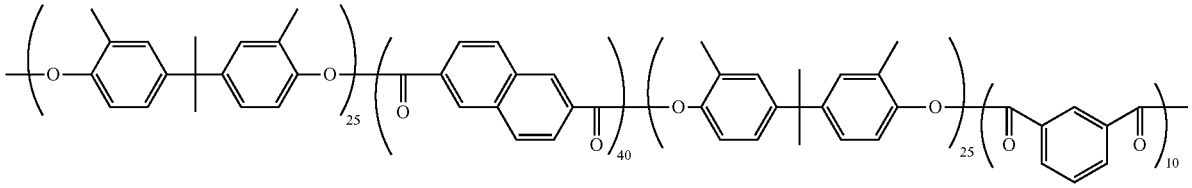
(Resin-12)
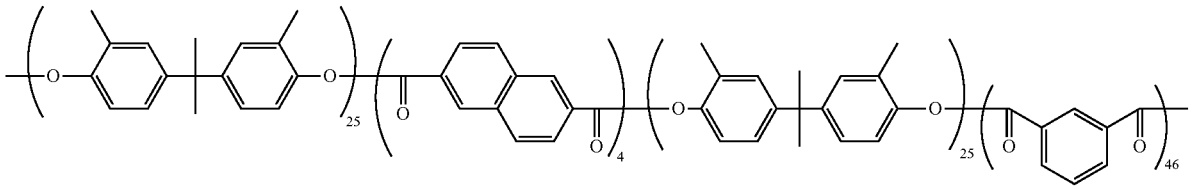

-continued (Resin-13)

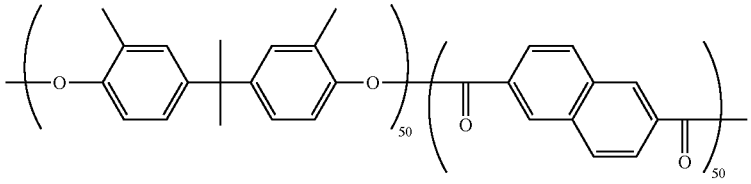

(Resin-14)

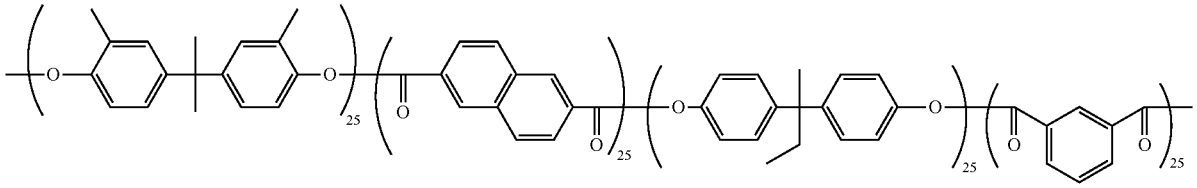

Of the polyarylate resins (Resin-1) to (Resin-14), the polyarylate resins (Resin-1) to (Resin-11) and (Resin-14), in which s/(s+u) in general formula (1) is at least 0.10 and no greater than 0.90, are particularly preferable in terms of increasing the effect of improving abrasion resistance of the photosensitive member.

The polyarylate resin (1) preferably has a viscosity average molecular weight of at least 20,000 and no greater than 80,000, and more preferably at least 35,000 and no greater than 65,000. As a result of the polyarylate resin (1) having a viscosity average molecular weight of at least 20,000, abrasion resistance of the photosensitive member can be improved, and therefore the photosensitive layer tends not to be abraded. As a result of the polyarylate resin (1) having a viscosity average molecular weight of no greater than 80,000, the polyarylate resin (1) is easily dissolved in a solvent for formation of the photosensitive layer, and therefore formation of the photosensitive layer tends to be easy.

The following describes a case in which the repeating unit (1-5) and the repeating unit (1-7) in the polyarylate resin (1) are the same as one another in more detail. When the repeating unit (1-5) and the repeating unit (1-7) in the polyarylate resin (1) are the same as one another, general formula (1) may be represented by general formula (1') shown below. Hereinafter, a polyarylate resin represented by general formula (1') may be referred to as a polyarylate resin (1').

association with general formula (1). The polyarylate resin (1') can be also described as having a repeating unit represented by general formula (1'-6) shown below and a repeating unit represented by general formula (1'-8) shown below. The repeating units represented by general formulae (1'-6) and (1'-8) may be respectively referred to as repeating units (1'-6) and (1'-8). $R^1$, $R^2$, $R^3$, and X in general formulae (1'-6) and (1'-8) represent the same as $R^1$, $R^2$, $R^3$, and X in general formula (1).

(1'-6)

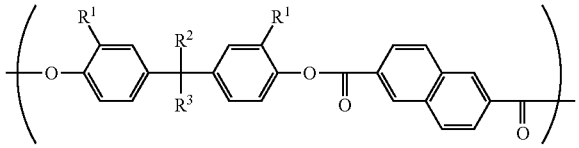

(1'-8)

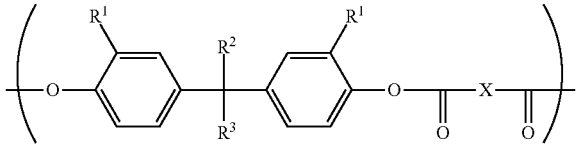

(1')

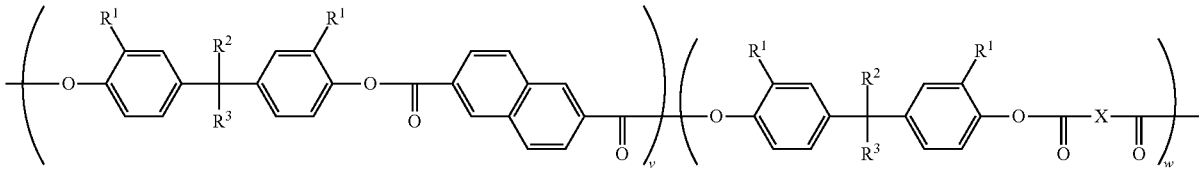

$R^1$, $R^2$, $R^3$, and X in general formula (1') represent the same as $R^1$, $R^2$, $R^3$, and X in general formula (1). In general formula (1'), v represents a number greater than or equal to 2. w represents a number greater than or equal to 0. v+w=100. v/(v+w) is greater than 0.00 and no greater than 1.00.

The polyarylate resin (1') has the repeating unit (1-5), the repeating unit (1-6), and the repeating unit (1-8) described in v in general formula (1') represents a percentage of the number of repeating units (1'-6) relative to a sum of the number of repeating units (1'-6) and the number of repeating units (1'-8). w in general formula (1') represents a percentage of the number of repeating units (1'-8) relative to a sum of the number of repeating units (1'-6) and the number of repeating units (1'-8).

When the repeating unit (1-5) and the repeating unit (1-7) in the polyarylate resin (1) are the same as one another, s and u, rather than r and t, in general formula (1) substantially controls the percentage of each repeating unit. Accordingly, s and u in general formula (1) respectively correspond to v and w in general formula (1'). More specifically, a value of v in general formula (1') is twice a value of s in general formula (1). Likewise, a value of w in general formula (1') is twice a value of u in general formula (1).

In general formula (1'), v preferably represents a number greater than or equal to 2 and less than or equal to 100, more preferably a number greater than or equal to 10 and less than or equal to 90, and particularly preferably a number greater than or equal to 20 and less than or equal to 80. In general formula (1'), w preferably represents a number greater than or equal to 0 and less than or equal to 98, more preferably a number greater than or equal to 10 and less than or equal to 90, and particularly preferably a number greater than or equal to 20 and less than or equal to 80. In general formula (1'), v/(v+w) is preferably at least 0.02 and no greater than 1.00, more preferably at least 0.10 and no greater than 0.90, and particularly preferably at least 0.20 and no greater than 0.80. Through the above, the case has been described in detail in which the repeating unit (1-5) and the repeating unit (1-7) in the polyarylate resin (1) are the same as one another.

As the binder resin that is used in the present embodiment, the polyarylate resin (1) may be used independently, or a resin other than the polyarylate resin (1) (optional resin) may be used in combination with the polyarylate resin (1). Examples of the optional resin include thermoplastic resins (for example, polyarylate resins other than the polyarylate resin (1), polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, polyester resins, alkyd resins, polyamide resins, polyurethane resins, polysulfone resins, diallyl phthalate resins, ketone resins, polyvinyl butyral resins, and polyether resins), thermosetting resins (for example, silicone resins, epoxy resins, phenolic resins, urea resins, melamine resins, and other cross-linkable thermosetting resins), and photocurable resins (for example, epoxy-acrylic acid-based resins and urethane-acrylic acid-based copolymers). Any one of the optional resins listed above may be used independently, or any two or more of the optional resins listed above may be used in combination.

No particular limitations are placed on the method for producing the polyarylate resin (1) so long as the method enables production of the polyarylate resin (1). Examples of production methods that can be employed include a method involving condensation polymerization of an aromatic dicarboxylic acid and an aromatic diol for forming repeating units of the polyarylate resin (1). No particular limitations are placed on a method for synthesizing the polyarylate resin (1), and a known synthesis method (specific examples include solution polymerization, melt polymerization, and interfacial polymerization) may be employed.

The aromatic dicarboxylic acid has two carboxyl groups and is represented by chemical formula (1-9) and general formula (1-10). X in general formula (1-10) represents the same as X in general formula (1).

(1-9)

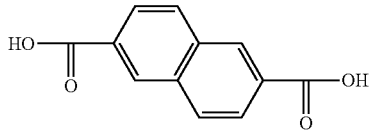

(1-10)

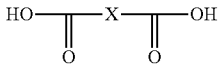

The aromatic dicarboxylic acid (2,6-naphthalene dicarboxylic acid) represented by chemical formula (1-9) and the aromatic dicarboxylic acid represented by general formula (1-10) are each an aromatic dicarboxylic acid having two carboxyl groups bonding to an aromatic ring. Specific examples of the aromatic dicarboxylic acid represented by general formula (1-10) include benzene-1,2-dicarboxylic acid, benzene-1,3-dicarboxylic acid, benzene-1,4-dicarboxylic acid, 4,4'-dicarboxydiphenyl ether, 1,4-bis(4-carboxyphenoxy)benzene, and 4,4'-dicarboxybiphenyl. For synthesizing the polyarylate resin (1), the aromatic dicarboxylic acid may be used in the form of a derivative such as an acid dichloride, a dimethyl ester, or a diethyl ester thereof. The aromatic dicarboxylic acid may include an aromatic dicarboxylic acid other than the aromatic dicarboxylic acids represented by chemical formula (1-9) and general formula (1-10).

The aromatic diol includes aromatic diols represented by general formulae (1-11) and (1-12) each having two phenolic hydroxyl groups. $R^1$, $R^2$, and $R^3$ in general formula (1-11) respectively represent the same as $R^1$, $R^2$, $R^3$ in general formula (1). $R^4$, $R^5$, and $R^6$ in general formula (1-12) respectively represent the same as $R^4$, $R^5$, and $R^6$ in general formula (1).

(1-11)

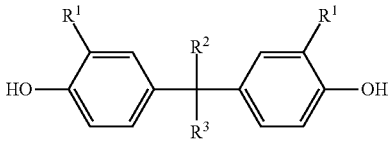

(1-12)

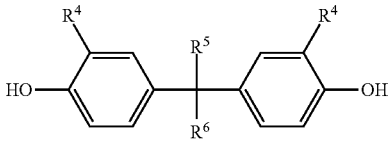

Examples of the aromatic diols represented by general formulae (1-11) and (1-12) include bisphenols (specific examples include bisphenol C and bisphenol B). For synthesizing the polyarylate resin (1), the aromatic diol may be used in the form of a derivative such as a diacetate thereof. The aromatic diol may include an aromatic diol (for example, bisphenol A, bisphenol Z, bisphenol E, or bisphenol F) other than the aromatic diols represented by general formulae (1-11) and (1-12).

The polyarylate resin (1) is preferably contained in an amount of at least 80% by mass relative to a mass of the binder resin, more preferably in an amount of at least 90% by mass, and particularly preferably in an amount of 100% by mass.

In the present embodiment, the ratio of the mass of the binder resin relative to a sum of masses of all the components (for example, the charge transport material and the binder resin) contained in the charge transport layer is preferably at least 40% by mass, and more preferably at least 60% by mass.

[2-1-4. Additives]

At least one of the charge generating layer of the multi-layer photosensitive member, the charge transport layer of the multi-layer photosensitive member, the photosensitive layer of the single-layer photosensitive member, and the intermediate layer may contain an additive so long as electrophotographic characteristics of the photosensitive member are not adversely affected. Examples of additives that can be used include antidegradants (specific examples include antioxidants, radical scavengers, quenchers, and ultraviolet absorbing agents), softeners, surface modifiers, extenders, thickeners, dispersion stabilizers, waxes, electron acceptor compounds, donors, surfactants, and leveling agents. Of the additives listed above, the antioxidants will be described.

Examples of antioxidants that can be used include hindered phenol compounds, hindered amine compounds, thioether compounds, and phosphite compounds. Of the antioxidants listed above, hindered phenol compounds and hindered amine compounds are preferable.

The amount of the antioxidant in the charge transport layer is preferably at least 0.1 parts by mass and no greater than 10 parts by mass relative to 100 parts by mass of the binder resin. As a result of the amount of the antioxidant being within the above-specified range, reduction in electrical characteristics due to oxidation of the photosensitive member is easily inhibited.

[2-2. Non-common Elements of Configuration]

The charge generating layer in the multi-layer photosensitive member may contain a binder resin for use in the charge generating layer (also referred to below as a base resin). No particular limitations are placed on the base resin other than being a base resin applicable to photosensitive members. Examples of base resins that can be used include thermoplastic resins, thermosetting resins, and photocurable resins. Examples of thermoplastic resins that can be used include styrene-based resins, styrene-butadiene copolymers, styrene-acrylonitrile copolymers, styrene-maleic acid copolymers, styrene-acrylic acid-based copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polycarbonate resins, polyarylate resins, polysulfone resins, diallyl phthalate resins, ketone resins, polyvinyl butyral resins, polyether resins, and polyester resins. Examples of thermosetting resins that can be used include silicone resins, epoxy resins, phenolic resins, urea resins, melamine resins, and other crosslinkable thermosetting resins. Examples of photocurable resins that can be used include epoxy-acrylic acid-based resins and urethane-acrylic acid-based resins. Any one of the resins listed above may be used independently, or any two or more of the resins listed above may be used in combination.

Although resins that are listed as examples of the binder resin described earlier are also listed as examples of the base resin, a resin that is different from the binder resin is normally selected as the base resin in the same multi-layer photosensitive member for the following reason. In manufacture of a multi-layer photosensitive member, a charge generating layer and a charge transport layer are normally formed in the stated order, and thus an application liquid for charge transport layer formation is normally coated onto the charge generating layer. The charge generating layer is required to be insoluble in a solvent of the application liquid for charge transport layer formation in the formation of the charge transport layer. Therefore, a resin that is different from the binder resin is normally selected as the base resin in the same multi-layer photosensitive member.

[3. Intermediate Layer]

The photosensitive member according to the present embodiment may have an intermediate layer (for example, an undercoat layer). The intermediate layer for example contains inorganic particles and a resin for use in the intermediate layer (intermediate layer resin). Provision of the intermediate layer may facilitate flow of current generated when the photosensitive member is exposed to light and inhibit increasing resistance, while also maintaining insulation to a sufficient degree so as to inhibit leakage current from occurring.

Examples of inorganic particles that can be used include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of the inorganic particles listed above may be used independently, or any two or more types of the inorganic particles listed above may be used in combination.

No particular limitations are placed on the intermediate layer resin other than being a resin usable for formation of intermediate layers.

[4. Photosensitive Member Production Method]

The following describes a method for producing the photosensitive member.

The method for producing the photosensitive member for example includes a photosensitive layer formation step.

[4-1. Multi-Layer Photosensitive Member Production Method]

In the method for producing the multi-layer photosensitive member, the photosensitive layer formation step includes a charge generating layer formation step and a charge transport layer formation step. In the charge generating layer formation step, first, an application liquid for formation of the charge generating layer (also referred to below as an application liquid for charge generating layer formation) is prepared. The application liquid for charge generating layer formation is applied onto a conductive substrate. Next, the application liquid for charge generating layer formation is dried by an appropriate method to remove at least a portion of a solvent contained in the applied application liquid for charge generating layer formation. Thus, the charge generating layer is formed. The application liquid for charge generating layer formation for example includes a charge generating material, a base resin, and a solvent. Such an application liquid for charge generating layer formation is prepared by dissolving or dispersing the charge generating material in the solvent. An additive may be added to the application liquid for charge generating layer formation as necessary.

In the charge transport layer formation step, first, an application liquid for formation of the charge transport layer (also referred to below as an application liquid for charge transport layer formation) is prepared. The application liquid for the charge transport layer is applied onto the charge generating layer. Next, the application liquid for charge transport layer formation is dried by an appropriate method to remove at least a portion of a solvent contained in the applied application liquid for charge transport layer formation. Thus, the charge transport layer is formed. The application liquid for charge transport layer formation contains a charge transport material, the polyarylate resin (1) as a binder resin, and a solvent. The application liquid for charge transport layer formation can be prepared by dissolving or dispersing the charge transport material and the polyarylate resin (1) in the solvent. An additive may be added to the application liquid for charge transport layer formation as necessary.

[4-2. Single-Layer Photosensitive Member Production Method]

In the photosensitive layer formation step in the method for producing the single-layer photosensitive member, an application liquid for formation of the single-layer photosensitive layer (also referred to below as an application liquid for photosensitive layer formation) is prepared. The application liquid for photosensitive layer formation is applied onto a conductive substrate. Next, the application liquid for photosensitive layer formation layer is dried by an appropriate method to remove at least a portion of a solvent contained in the applied application liquid for photosensitive layer formation. Thus, the photosensitive layer is formed. The application liquid for photosensitive layer formation for example contains a charge generating material, a charge transport material, a binder resin, and a solvent. Such an application liquid for photosensitive layer formation is prepared by dissolving or dispersing the charge generating material, the charge transport material, and the binder resin in the solvent. An additive may be added to the application liquid for photosensitive layer formation as necessary.

The following describes the photosensitive layer formation step in detail. No particular limitations are placed on the solvents contained in the application liquid for charge generating layer formation, the application liquid for charge transport layer formation, and the application liquid for photosensitive layer formation other than that the components of each of the application liquids should be soluble or dispersible in the solvent. Specific examples of solvents that can be used include alcohols (for example, methanol, ethanol, isopropanol, and butanol), aliphatic hydrocarbons (for example, n-hexane, octane, and cyclohexane), aromatic hydrocarbons (for example, benzene, toluene, and xylene), halogenated hydrocarbons (for example, dichloromethane, dichloroethane, carbon tetrachloride, and chlorobenzene), ethers (for example, dimethyl ether, diethyl ether, tetrahydrofuran, ethylene glycol dimethyl ether, and diethylene glycol dimethyl ether), ketones (for example, acetone, methyl ethyl ketone, and cyclohexanone), esters (for example, ethyl acetate and methyl acetate), dimethyl formaldehyde, dimethyl formamide, and dimethyl sulfoxide. Any one of the solvents listed above may be used independently, or any two or more of the solvents listed above may be used in combination. Of the solvents listed above, use of a non-halogenated solvent is preferable.

In manufacture of a multi-layer photosensitive member, a charge generating layer and a charge transport layer are normally formed in the stated order, and thus the application liquid for charge transport layer formation is normally coated onto the charge generating layer. The charge generating layer is required to be insoluble in the solvent of the application liquid for charge transport layer formation in the formation of the charge transport layer. Therefore, the solvent contained in the application liquid for charge transport layer formation is preferably different from the solvent contained in the application liquid for charge generating layer formation.

Each of the application liquid for charge generating layer formation, the application liquid for charge transport layer formation, and the application liquid for photosensitive layer formation is prepared by mixing and dispersing the components in the solvent. Mixing or dispersion can for example be performed using a bead mill, a roll mill, a ball mill, an attritor, a paint shaker, or an ultrasonic disperser.

The application liquid for charge generating layer formation, the application liquid for charge transport layer formation, and the application liquid for photosensitive layer formation may for example include a surfactant or a leveling agent in order to improve dispersibility of the components or improve surface flatness of the formed layers.

No specific limitations are placed on the method by which each of the application liquid for charge generating layer formation, the application liquid for charge transport layer formation, and the application liquid for photosensitive layer formation is applied other than being a method that enables uniform application of the application liquid. Examples of application methods that can be used include dip coating, spray coating, spin coating, and bar coating.

No specific limitations are placed on the method by which at least a portion of the solvent in each of the application liquid for charge generating layer formation, the application liquid for charge transport layer formation, and the application liquid for photosensitive layer formation is removed other than being a method that enables evaporation of the solvent in the application liquid. Examples of methods that can be used to remove the solvent include heating, pressure reduction, and a combination of heating and pressure reduction. One specific example of a method involves heat treatment (hot-air drying) using a high-temperature dryer or a reduced pressure dryer. The heat treatment is for example performed for at least 3 minutes and no greater than 120 minutes at a temperature of at least 40° C. and no greater than 150° C.

The method for producing the photosensitive member may further include an intermediate layer formation step as necessary. The intermediate layer formation step can be carried out by a method selected as appropriate from known methods.

The photosensitive member according to the present disclosure described above can be favorably used in various image forming apparatuses as having excellent abrasion resistance.

EXAMPLES

The following provides more specific description of the present disclosure through examples. Note that the present disclosure is not in any way limited by the following examples.

Photosensitive Member Production

[Production of Photosensitive Member (A-1)]

The following describes production of a photosensitive member (A-1) according to Example 1.

(Intermediate Layer Formation)

First, surface treated titanium oxide (test sample "SMT-A", product of Tayca Corporation, number average primary particle size 10 nm) was prepared. More specifically, titanium oxide particles were surface treated using alumina and silica and were also subsequently surface treated using methyl hydrogen polysiloxane while being subjected to wet dispersion. Next, the surface treated titanium oxide (2 parts by mass) and Amilan (registered Japanese trademark) ("CM8000", product of Toray Industries, Inc.), which is a polyamide resin (a four-component copolymer polyamide resin of polyamide 6, polyamide 12, polyamide 66, and polyamide 610), (1 part by mass) were added to a solvent containing methanol (10 parts by mass), butanol (1 part by mass), and toluene (1 part by mass). The mixture was mixed for 5 hours using a bead mill to disperse the materials in the solvent. Through the above process, an application liquid for intermediate layer formation was prepared.

The obtained application liquid for intermediate layer formation was filtered using a filter having a pore size of 5 μm. After filtration, the application liquid for intermediate layer formation was applied onto the surface of a conductive substrate—an aluminum drum-shaped support (diameter 30 mm, total length 246 mm)—by dip coating. Next, the applied application liquid for intermediate layer formation was dried for 30 minutes at 130° C., thereby forming an intermediate layer (film thickness 2 μm) on the conductive substrate (drum-shaped support).

(Charge Generating Layer Formation)

Y-form titanyl phthalocyanine as a charge generating material (1.5 parts by mass) and a polyvinyl acetal resin ("S-LEC BX-5", product of Sekisui Chemical Co., Ltd.) as a base resin (1 part by mass) were added to a solvent containing propylene glycol monomethyl ether (40 parts by mass) and tetrahydrofuran (40 parts by mass). The mixture was mixed for 2 hours using a bead mill to disperse the materials in the solvent. Thus, an application liquid for charge generating layer formation was prepared. Note that the Y-form titanyl phthalocyanine is represented by chemical formula (CGM-2) and exhibits a main peak at a Bragg angle $2\theta \pm 0.2° = 27.2°$ in a CuKα characteristic X-ray diffraction spectrum.

The resultant application liquid for charge generating layer formation was filtered using a filter having a pore size of 3 μm. After filtration, the resultant filtrate was applied by dip coating onto the intermediate layer formed as described above and was dried for 5 minutes at 50° C. Through the above, a charge generating layer (film thickness 0.3 μm) was formed on the intermediate layer.

(Charge Transport Layer Formation)

The charge transport material (CTM-1) as a hole transport material (50 parts by mass), a hindered phenolic antioxidant ("IRGANOX (registered Japanese trademark) 1010", product of BASF Japan Ltd.) as an additive (2 parts by mass), and the polyarylate resin (Resin-1) (viscosity average molecular weight 50,500) as a binder resin (100 parts by mass) were added to a solvent containing tetrahydrofuran (350 parts by mass) and toluene (350 parts by mass). Mixing of the above materials was performed for 12 hours using a circulating ultrasonic disperser in order to disperse the materials in the solvent. Thus, an application liquid for charge transport layer formation was prepared.

The application liquid for charge transport layer formation was applied through the same operation as the application liquid for charge generating layer formation onto the charge generating layer. Next, the application liquid for charge transport layer formation was dried for 40 minutes at 120° C. to yield a charge transport layer (film thickness 20 μm) on the charge generating layer. The photosensitive member (A-1) was obtained as a result of the process described above. In the photosensitive member (A-1), the intermediate layer, the charge generating layer, and the charge transport layer were stacked in the stated order on the conductive substrate.

[Photosensitive Member (A-2)]

A photosensitive member (A-2) was produced according to the same method as the photosensitive member (A-1) in all aspects other than that the charge transport material (CTM-2) was used as a hole transport material instead of the charge transport material (CTM-1).

[Photosensitive Member (A-3)]

A photosensitive member (A-3) was produced according to the same method as the photosensitive member (A-1) in all aspects other than that the charge transport material (CTM-3) was used as a hole transport material instead of the charge transport material (CTM-1).

[Photosensitive Member (A-4)]

A photosensitive member (A-4) was produced according to the same method as the photosensitive member (A-1) in all aspects other than that the charge transport material (CTM-4) was used as a hole transport material instead of the charge transport material (CTM-1).

[Photosensitive Member (A-5)]

A photosensitive member (A-5) was produced according to the same method as the photosensitive member (A-1) in all aspects other than that the charge transport material (CTM-5) was used as a hole transport material instead of the charge transport material (CTM-1).

[Photosensitive Member (A-6)]

A photosensitive member (A-6) was produced according to the same method as the photosensitive member (A-1) in all aspects other than that the charge transport material (CTM-6) was used as a hole transport material instead of the charge transport material (CTM-1).

[Photosensitive Member (A-7)]

A photosensitive member (A-7) was produced according to the same method as the photosensitive member (A-1) in all aspects other than that the charge transport material (CTM-7) was used as a hole transport material instead of the charge transport material (CTM-1).

[Photosensitive Member (A-8)]

A photosensitive member (A-8) was produced according to the same method as the photosensitive member (A-1) in all aspects other than that the charge transport material (CTM-8) was used as a hole transport material instead of the charge transport material (CTM-1).

[Photosensitive Member (A-9)]

A photosensitive member (A-9) was produced according to the same method as the photosensitive member (A-1) in all aspects other than that the charge transport material (CTM-9) was used as a hole transport material instead of the charge transport material (CTM-1).

[Photosensitive Member (A-10)]

A photosensitive member (A-10) was produced according to the same method as the photosensitive member (A-1) in all aspects other than that the polyarylate resin (Resin-2) was used as a binder resin instead of the polyarylate resin (Resin-1).

[Photosensitive Member (A-11)]

A photosensitive member (A-11) was produced according to the same method as the photosensitive member (A-1) in all aspects other than that the polyarylate resin (Resin-3) was used as a binder resin instead of the polyarylate resin (Resin-1).

[Photosensitive Member (A-12)]

A photosensitive member (A-12) was produced according to the same method as the photosensitive member (A-1) in all aspects other than that the polyarylate resin (Resin-4) was used as a binder resin instead of the polyarylate resin (Resin-1).

[Photosensitive Member (A-13)]

A photosensitive member (A-13) was produced according to the same method as the photosensitive member (A-1) in all aspects other than that the polyarylate resin (Resin-5) was used as a binder resin instead of the polyarylate resin (Resin-1).

[Photosensitive Member (A-14)]

A photosensitive member (A-14) was produced according to the same method as the photosensitive member (A-1) in all aspects other than that the polyarylate resin (Resin-6) was used as a binder resin instead of the polyarylate resin (Resin-1).

[Photosensitive Member (A-15)]

A photosensitive member (A-15) was produced according to the same method as the photosensitive member (A-1) in all aspects other than that the polyarylate resin (Resin-7) was used as a binder resin instead of the polyarylate resin (Resin-1).

[Photosensitive Member (A-16)]

A photosensitive member (A-16) was produced according to the same method as the photosensitive member (A-1) in all aspects other than that the polyarylate resin (Resin-8) was used as a binder resin instead of the polyarylate resin (Resin-1).

[Photosensitive Member (A-17)]

A photosensitive member (A-17) was produced according to the same method as the photosensitive member (A-1) in all aspects other than that the polyarylate resin (Resin-9) was used as a binder resin instead of the polyarylate resin (Resin-1).

[Photosensitive Member (A-18)]

A photosensitive member (A-18) was produced according to the same method as the photosensitive member (A-1) in all aspects other than that the polyarylate resin (Resin-10) was used as a binder resin instead of the polyarylate resin (Resin-1).

[Photosensitive Member (A-19)]

A photosensitive member (A-19) was produced according to the same method as the photosensitive member (A-1) in all aspects other than that the polyarylate resin (Resin-11) was used as a binder resin instead of the polyarylate resin (Resin-1).

[Photosensitive Member (A-20)]

A photosensitive member (A-20) was produced according to the same method as the photosensitive member (A-1) in all aspects other than that the polyarylate resin (Resin-12) was used as a binder resin instead of the polyarylate resin (Resin-1).

[Photosensitive Member (A-21)]

A photosensitive member (A-21) was produced according to the same method as the photosensitive member (A-1) in all aspects other than that the polyarylate resin (Resin-13) was used as a binder resin instead of the polyarylate resin (Resin-1).

[Photosensitive Member (A-22)]

A photosensitive member (A-22) was produced according to the same method as the photosensitive member (A-1) in all aspects other than that the polyarylate resin (Resin-14) was used as a binder resin instead of the polyarylate resin (Resin-1).

[Photosensitive Member (B-1)]

A photosensitive member (B-1) was produced according to the same method as the photosensitive member (A-1) in all aspects other than that the polyarylate resin (Resin-A) was used as a binder resin instead of the polyarylate resin (Resin-1).

[Evaluation of Photosensitive Member Properties]

<Evaluation of Electrical Characteristics>

(Measurement of charge potential $V_0$)

With respect to each of the photosensitive members (A-1) to (A-22) and (B-1), the surface potential of the photosensitive member was measured under conditions of a photosensitive drum rotation speed of 31 rpm and an inflow current of −10 μmA using a drum sensitivity test device (product of Gen-Tech, Inc.). The measured surface potential was taken to be a charge potential ($V_0$). Measurement was performed under ambient conditions of 23° C. and 50% relative humidity.

(Measurement of Post-Irradiation Potential $V_L$)

With respect to each of the photosensitive members (A−1) to (A-22) and (B-1), the photosensitive member was charged to −600 V at a photosensitive drum rotation speed of 31 rpm, using a drum sensitivity test device (product of Gen-Tech, Inc.). Next, a band pass filter was used to obtain monochromatic light (wavelength 780 nm, light intensity 0.8 μJ/cm$^2$) from light emitted by a halogen lamp and the surface of the photosensitive member was irradiated with the obtained monochromatic light. The surface potential of the photosensitive member was measured 80 milliseconds after completion of irradiation with the monochromatic light. The measured surface potential was taken to be a post-irradiation potential ($V_L$). Measurement was performed under ambient conditions of 23° C. and 50% relative humidity.

<Evaluation of Abrasion Resistance>

With respect to each of the photosensitive members (A-1) to (A-22) and (B-1), the application liquid for charge transport layer formation prepared in the production of the photosensitive member was applied onto a polypropylene sheet (thickness 0.3 mm) wound around an aluminum pipe (diameter 78 mm). Drying was performed at 120° C. for 40 minutes to prepare an abrasion evaluation test sheet having a charge transport layer with a film thickness of 30 μm formed thereon.

A sample was prepared by removing the charge transport layer from the polypropylene sheet and mounting the charge transport layer on a specimen mounting card S-36 (manufactured by TABER Industries). A 1,000 rotation abrasion test was performed on the prepared sample by a rotary abrasion tester (product of Toyo Seiki Co., Ltd.), using a wear ring CS-10 (product of TABER Industries) under conditions of a 500 gf load and a rotation speed of 60 rpm. An abrasion loss (mg/1,000 rotations), which is a difference in mass of the sample before and after the abrasion test, was measured. Abrasion resistance of the photosensitive member was evaluated based on the thus obtained abrasion loss.

Table 1 shows a component and a result of the evaluation of properties of each of the photosensitive members (A-1) to (A-22) and (B-1). In Table 1, the molecular weight of each polyarylate resin is a viscosity average molecular weight.

TABLE 1

| | Charge transport layer | | | | Electrical characteristics | | Abrasion resistance |
|---|---|---|---|---|---|---|---|
| | | Polyarylate resin | | | | | |
| Photosensitive member | Charge transport material | Type | Molecular weight | s/(s + u) | $V_0$ (V) | $V_L$ (V) | Abrasion loss (mg/1000 rotations) |
| A-1 | CTM-1 | Resin-1 | 50500 | 0.50 | −688 | −61 | 6.5 |
| A-2 | CTM-2 | Resin-1 | 50500 | 0.50 | −685 | −70 | 6.7 |

TABLE 1-continued

| Photosensitive member | Charge transport material | Charge transport layer: Polyarylate resin: Type | Molecular weight | s/(s + u) | Electrical characteristics: $V_0$ (V) | $V_L$ (V) | Abrasion resistance: Abrasion loss (mg/1000 rotations) |
|---|---|---|---|---|---|---|---|
| A-3 | CTM-3 | Resin-1 | 50500 | 0.50 | −698 | −68 | 6.3 |
| A-4 | CTM-4 | Resin-1 | 50500 | 0.50 | −664 | −50 | 6.1 |
| A-5 | CTM-5 | Resin-1 | 50500 | 0.50 | −679 | −54 | 5.6 |
| A-6 | CTM-6 | Resin-1 | 50500 | 0.50 | −664 | −58 | 5.9 |
| A-7 | CTM-7 | Resin-1 | 50500 | 0.50 | −665 | −54 | 6.3 |
| A-8 | CTM-8 | Resin-1 | 50500 | 0.50 | −678 | −70 | 6.4 |
| A-9 | CTM-9 | Resin-1 | 50500 | 0.50 | −672 | −54 | 6.5 |
| A-10 | CTM-1 | Resin-2 | 47500 | 0.50 | −694 | −74 | 4.2 |
| A-11 | CTM-1 | Resin-3 | 52400 | 0.50 | −677 | −58 | 5.8 |
| A-12 | CTM-1 | Resin-4 | 51000 | 0.50 | −659 | −78 | 6.7 |
| A-13 | CTM-1 | Resin-5 | 45500 | 0.50 | −664 | −52 | 6.2 |
| A-14 | CTM-1 | Resin-6 | 50500 | 0.50 | −663 | −53 | 6.2 |
| A-15 | CTM-1 | Resin-7 | 50100 | 0.50 | −668 | −52 | 6.4 |
| A-16 | CTM-1 | Resin-8 | 54500 | 0.50 | −652 | −65 | 6.9 |
| A-17 | CTM-1 | Resin-9 | 52100 | 0.50 | −655 | −77 | 7.0 |
| A-18 | CTM-1 | Resin-10 | 48100 | 0.14 | −680 | −60 | 6.9 |
| A-19 | CTM-1 | Resin-11 | 47000 | 0.80 | −674 | −60 | 4.9 |
| A-20 | CTM-1 | Resin-12 | 54300 | 0.08 | −692 | −58 | 7.6 |
| A-21 | CTM-1 | Resin-13 | 35000 | 1.00 | −690 | −63 | 7.4 |
| A-22 | CTM-1 | Resin-14 | 53500 | 0.50 | −874 | −66 | 5.3 |
| B-1 | CTM-1 | Resin-A | 52000 | — | −670 | −54 | 10.2 |

As shown in Table 1, the charge transport layer in each of the photosensitive members (A-1) to (A-22) contained the polyarylate resin (1) as a binder resin. More specifically, the charge transport layer of each of the photosensitive members (A-1) to (A-22) contained one of the polyarylate resins (Resin-1) to (Resin-14). As shown in Table 1, the photosensitive members (A-1) to (A-22) each resulted in an abrasion loss in a range of from 4.2 mg to 7.6 mg.

As shown in Table 1, the charge transport layer of the photosensitive member (B-1) contained the polyarylate resin (Resin-A). However, the polyarylate resin (Resin-A) was not the polyarylate resin (1). More specifically, the polyarylate resin (Resin-A) did not have the repeating unit (1-6) (repeating unit including a naphthalene ring), which is included in the polyarylate resin (1). As shown in Table 1, the photosensitive member (B-1) resulted in an abrasion loss of 10.2 mg.

As apparent from Table 1, the photosensitive members according to the present embodiment (more specifically, the photosensitive members (A-1) to (A-22)) each resulted in a small abrasion loss in the abrasion resistance evaluation compared to the photosensitive member (B-1). That is, the photosensitive members according to the present disclosure exhibited excellent abrasion resistance.

As shown in Table 1, the charge transport layer of the photosensitive member (A-10) and the charge transport layer of the photosensitive member (A-11) respectively contained the polyarylate resin (Resin-2) and the polyarylate resin (Resin-3). The polyarylate resins (Resin-2) and (Resin-3) were each the polyarylate resin (1) represented by general formula (1) wherein $R^2$ and $R^5$ each represent a methyl group, $R^3$ and $R^6$ each represent an ethyl group, and X represents a divalent group represented by chemical formula (1-1). As shown in Table 1, the photosensitive member (A-10) resulted in an abrasion loss of 4.2 mg, and the photosensitive member (A-11) resulted in an abrasion loss of 5.8 mg.

As apparent from Table 1, the photosensitive members (A-10) and (A-11), which contained the polyarylate resin (1) represented by general formula (1) wherein $R^2$ and $R^5$ each represent a methyl group, $R^3$ and $R^6$ each represent an ethyl group, and X represents a divalent group represented by chemical formula (1-1), exhibited particularly excellent abrasion resistance.

As shown in Table 1, the charge transport layer of the photosensitive member (A-14) and the charge transport layer of the photosensitive member (A-15) respectively contained the polyarylate resin (Resin-6) and the polyarylate resin (Resin-7). The polyarylate resins (Resin-6) and (Resin-7) were each the polyarylate resin (1) represented by general formula (1) wherein $R^2$ and $R^5$ each represent a methyl group, and X represents a divalent group represented by chemical formula (1-2). As shown in Table 1, the photosensitive member (A-14) resulted in a post-irradiation potential of −53 V, and the photosensitive member (A-15) resulted in a post-irradiation potential of −52 V.

As apparent from Table 1, the photosensitive members (A-14) and (A-15), which contained the polyarylate resin (1) represented by general formula (1) wherein $R^2$ and $R^5$ each represent a methyl group, and X represents a divalent group represented by chemical formula (1-2), exhibited excellent abrasion resistance and excellent electrical characteristics (in particular, sensitivity characteristics).

As shown in Table 1, the charge transport layer of each of the photosensitive members (A-1) to (A-19) and (A-22) contained one of the polyarylate resins (Resin-1) to (Resin-1) and (Resin-14). s/(s+u) of each of the polyarylate resins (Resin-1) to (Resin-11) and (Resin-14) was in a range of from 0.10 to 0.90. As shown in Table 1, the photosensitive members (A-1) to (A-19) and (A-22) each resulted in an abrasion loss in a range of from 4.2 mg to 7.0 mg.

As shown in Table 1, the charge transport layer of the photosensitive member (A-20) contained the polyarylate resin (Resin-12). s/(s+u) of the polyarylate resin (Resin-12) was 0.08. As shown in Table 1, the photosensitive member (A-20) resulted in an abrasion loss of 7.6 mg.

As shown in Table 1, the charge transport layer of the photosensitive member (A-21) contained the polyarylate resin (Resin-13). s/(s+u) of the polyarylate resin (Resin-13) was 1.00. As shown in Table 1, the photosensitive member (A-21) resulted in an abrasion loss of 7.4 mg.

As apparent from Table 1, the photosensitive members (A-1) to (A-19) and (A-22), which contained the polyarylate resin (1) with s/(s+u) in a range of from 0.10 to 0.90, exhibited particularly superior abrasion resistance to the photosensitive members (A-20) and (A-21), which did not contain the polyarylate resin (1) with s/(s+u) in a range of from 0.10 to 0.90.

As shown in Table 1, the charge transport layer of the photosensitive member (A-22) contained the polyarylate resin (Resin-14). The polyarylate resin (Resin-14) had a structure in which the two aromatic diol-derived repeating units (more specifically, the repeating unit (1-5) and the repeating unit (1-7)) were different from one another. As shown in Table 1, the photosensitive member (A-22) resulted in an abrasion loss of 5.3 mg.

As apparent from Table 1, the photosensitive member (A-22), which contained the polyarylate resin (1) having a structure in which the two aromatic diol-derived repeating units were different from one another, exhibited as excellent abrasion resistance as the photosensitive members (A-1) to (A-19), which contained the polyarylate resin (1) in which the two aromatic diol-derived repeating units were the same as one another.

As shown in Table 1, the charge transport layer of the photosensitive member (A-5) and the charge transport layer of the photosensitive member (A-6) respectively contained the charge transport material (CTM-5) and the charge transport material (CTM-6). The charge transport materials (CTM-5) and (CTM-6) were each a compound represented by general formula (3) wherein $Q^8$, $Q^{10}$, $Q^{11}$, $Q^{12}$, $Q^{13}$, and $Q^{14}$ each represent, independently of one another, a hydrogen atom or an alkyl group having a carbon number of at least 1 and no greater than 4, and b and c each represent 0. As shown in Table 1, the photosensitive member (A-5) resulted in an abrasion loss of 5.6 mg, and the photosensitive member (A-6) resulted in an abrasion loss of 5.9 mg.

As apparent from Table 1, the photosensitive members (A-5) and (A-6), which contained the polyarylate resin (1) as a binder resin and contained as a charge transport material a compound represented by general formula (3) wherein $Q^8$, $Q^{10}$, $Q^{11}$, $Q^{12}$, $Q^{13}$ and $Q^{14}$ each represent, independently of one another, a hydrogen atom or an alkyl group having a carbon number of at least 1 and no greater than 4, and b and c each represent 0, exhibited particularly excellent abrasion resistance.

What is claimed is:

1. An electrophotographic photosensitive member comprising a conductive substrate and a photosensitive layer, wherein the photosensitive layer contains at least a charge generating material, a charge transport material, and a binder resin, the binder resin includes a polyarylate resin, the polyarylate resin is represented by general formula (1) shown below, (1)

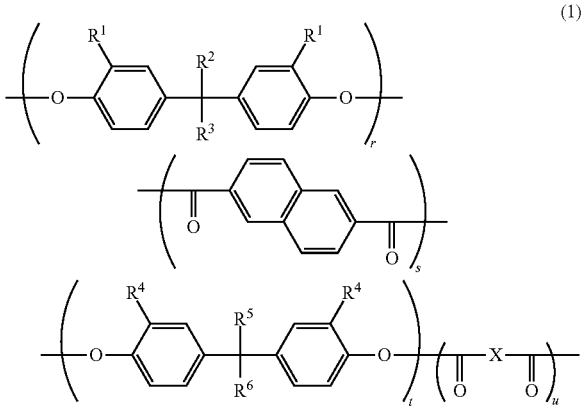

where in general formula (1), $R^1$ represents a hydrogen atom or an alkyl group having a carbon number of at least 1 and no greater than 4, the two chemical groups $R^1$ may be the same or different to one another, $R^2$ and $R^3$ each represent, independently of one another, a hydrogen atom, an alkyl group having a carbon number of at least 1 and no greater than 4, or a phenyl group, $R^2$ and $R^3$ may be bonded to one another to form a ring, representing a cycloalkylidene group having a carbon number of at least 3 and no greater than 8, $R^4$ represents a hydrogen atom or an alkyl group having a carbon number of at least 1 and no greater than 4, the two chemical groups $R^4$ may be the same or different to one another, $R^5$ and $R^6$ each represent, independently of one another, a hydrogen atom, an alkyl group having a carbon number of at least 1 and no greater than 4, or a phenyl group, $R^5$ and $R^6$ may be bonded to one another to form a ring, representing a cycloalkylidene group having a carbon number of at least 3 and no greater than 8, r and s each represent, independently of one another, a number greater than or equal to 1, t and u each represent, independently of one another, a number greater than or equal to 5, r+s+t+u=100, r+t=s+u, s/(s+u) is greater than 0.00 and no greater than 0.90, and X represents a divalent group represented by chemical formula (1-2), (1-3), or (1-4) shown below (1-2)

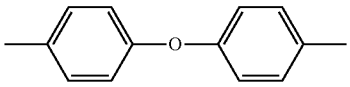

(1-3)

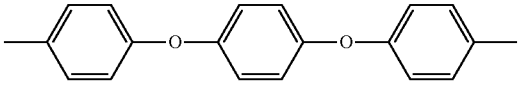

(1-4)

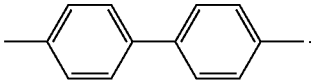

2. The electrophotographic photosensitive member according to claim 1, wherein in general formula (1), the two chemical groups $R^1$ are the same as one another, the two chemical groups $R^4$ are the same as one another, $R^1$ and $R^4$ are the same as one another, $R^2$ and $R^5$ are the same as one another, and $R^3$ and $R^6$ are the same as one another.

3. The electrophotographic photosensitive member according to claim 2, wherein in general formula (1), $R^1$ and $R^4$ each represent a hydrogen atom, or $R^1$ and $R^4$ each represent a methyl group, and $R^2$ and $R^5$ each represent a methyl group, and $R^3$ and $R^6$ each represent an alkyl group having a carbon number of at least 1 and no greater than 3, or $R^2$ and $R^3$ are bonded to one another to form a ring, representing a cyclohexylidene group, and $R^5$ and $R^6$ are bonded to one another to form a ring, representing a cyclohexylidene group.

4. The electrophotographic photosensitive member according to claim 1, wherein in general formula (1), $R^1$, $R^2$, $R^3$, $R^4$, $R^5$, and $R^6$ each represent a chemical group which satisfies at least one of a first condition that $R^1$ and $R^4$ are different from one another, a second condition that $R^2$ and $R^5$ are different from one another, and a third condition that $R^3$ and $R^6$ are different from one another.

5. The electrophotographic photosensitive member according to claim 1, wherein in general formula (1), r and s each represent, independently of one another, a number greater than or equal to 1 and less than or equal to 45, t and u each represent, independently of one another, a number greater than or equal to 5 and less than or equal to 49, and s/(s+u) is at least 0.02 and no greater than 0.90.

6. The electrophotographic photosensitive member according to claim 1, wherein in general formula (1), s/(s+u) is at least 0.10 and no greater than 0.90.

7. The electrophotographic photosensitive member according to claim 1, wherein the polyarylate resin is a polyarylate resin represented by chemical formula (Resin-6), (Resin-7), (Resin-8), or (Resin-9) shown below (Resin-6)

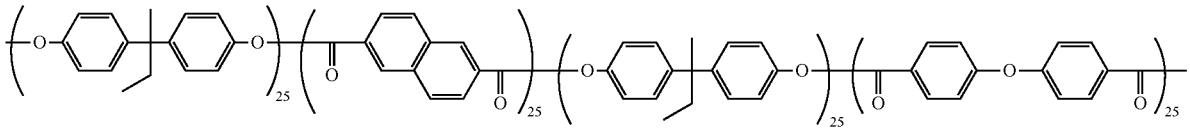

(Resin-7)

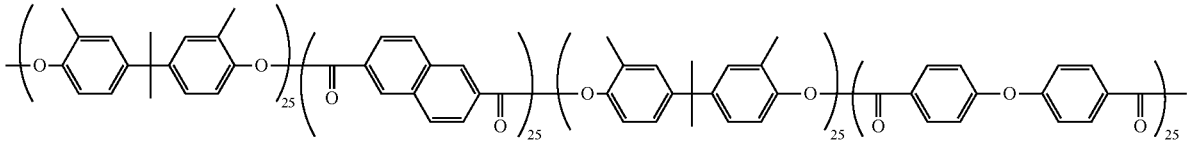

(Resin-8)

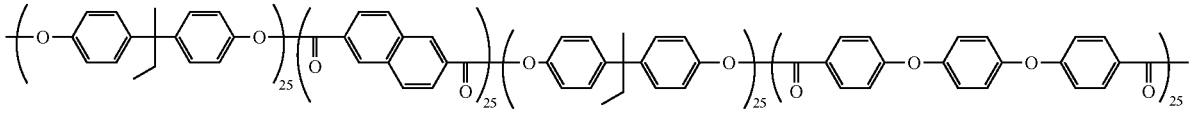

(Resin-9)

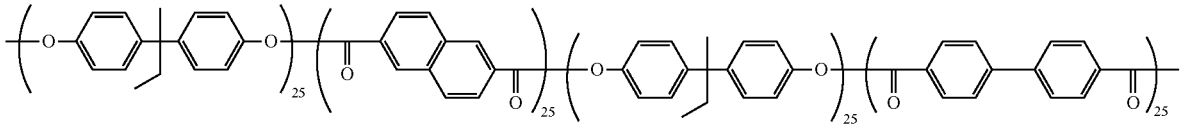

8. The electrophotographic photosensitive member according to claim 1, wherein in general formula (1), $R^2$ and $R^5$ each represent a methyl group, and X represents a divalent group represented by chemical formula (1-2).

9. The electrophotographic photosensitive member according to claim 1, wherein the charge transport material includes a compound represented by general formula (2), (3), or (4) shown below, (2)

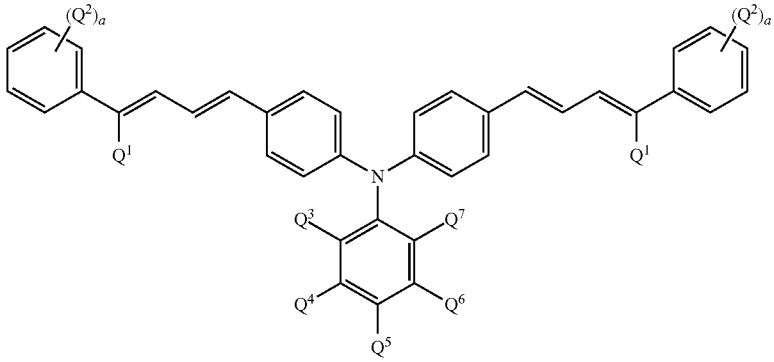

where in general formula (2), $Q^1$ represents a hydrogen atom, an alkyl group having a carbon number of at least 1 and no greater than 8, an alkoxy group having a carbon number of at least 1 and no greater than 8, or a phenyl group optionally substituted with an alkyl group having a carbon number of at least 1 and no greater than 8, $Q^2$ represents an alkyl group having a carbon number of at least 1 and no greater than 8, an alkoxy group having a carbon number of at least 1 and no greater than 8, or a phenyl group, $Q^3$, $Q^4$, $Q^5$, $Q^6$, and $Q^7$ each represent, independently of one another, a hydrogen atom, an alkyl group having a carbon number of at least 1 and no greater than 8, an alkoxy group having a carbon number of at least 1 and no greater than 8, or a phenyl group, two adjacent members among $Q^3$, $Q^4$, $Q^5$, $Q^6$, and $Q^7$ may be bonded to one another to form a ring, a represents an integer of at least 0 and no greater than 5, and when a represents an integer of at least 2 and no greater than 5, chemical groups $Q^2$ bonded to the same phenyl group may be the same or different to one another, (3)

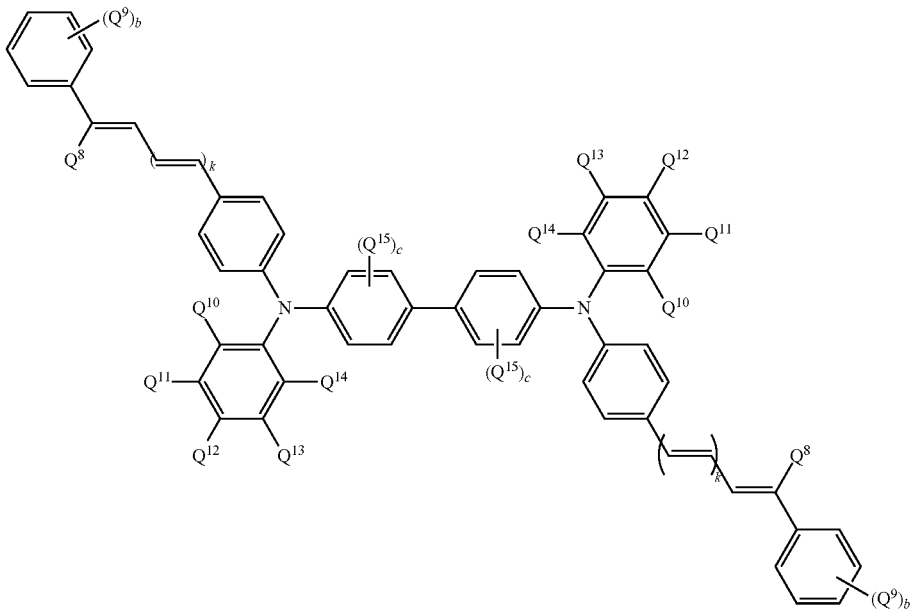

in general formula (3), $Q^8$, $Q^{10}$, $Q^{11}$, $Q^{12}$, $Q^{13}$, $Q^{14}$ each represent, independently of one another, a hydrogen atom, an alkyl group having a carbon number of at least 1 and no greater than 8, an alkoxy group having a carbon number of at least 1 and no greater than 8, or a phenyl group, $Q^9$ and $Q^{15}$ each represent, independently of one another, an alkyl group having a carbon number of at least 1 and no greater than 8, an alkoxy group having a carbon number of at least 1 and no greater than 8, or a phenyl group, b represents an integer of at least 0 and no greater than 5, when b represents an integer of at least 2 and no greater than 5, chemical groups $Q^9$ bonded to the same phenyl group may be the same or different to one another, c represents an integer of at least 0 and no greater than 4, when c represents an integer of at least 2 and no greater than 4, chemical groups $Q^{15}$ bonded to the same phenylene group may be the same or different to one another, and k represents 0 or 1, and in general formula (2), $Q^1$ represents a hydrogen atom or a phenyl group substituted with an alkyl group having a carbon number of at least 1 and no greater than 4, $Q^2$ represents an alkyl group having a carbon number of at least 1 and no greater than 4, $Q^3$, $Q^4$, $Q^5$, $Q^6$, and $Q^7$ each represent, independently of one another, a hydrogen atom, an alkyl group having a carbon number of at least 1 and no greater than 4, or an alkoxy group having a carbon number of at least 1 and no greater than 4, two adjacent members among $Q^3$, $Q^4$, $Q^5$, $Q^6$, and $Q^7$ may be bonded to one another to form a ring, and a represents 0 or 1, and in general formula (3), $Q^8$, $Q^{10}$, $Q^{11}$, $Q^{12}$, $Q^{13}$, and $Q^{14}$ each represent, independently of one another, a hydrogen atom, an alkyl group having a carbon number of at least 1 and no greater than 4, or a phenyl group, and (4)

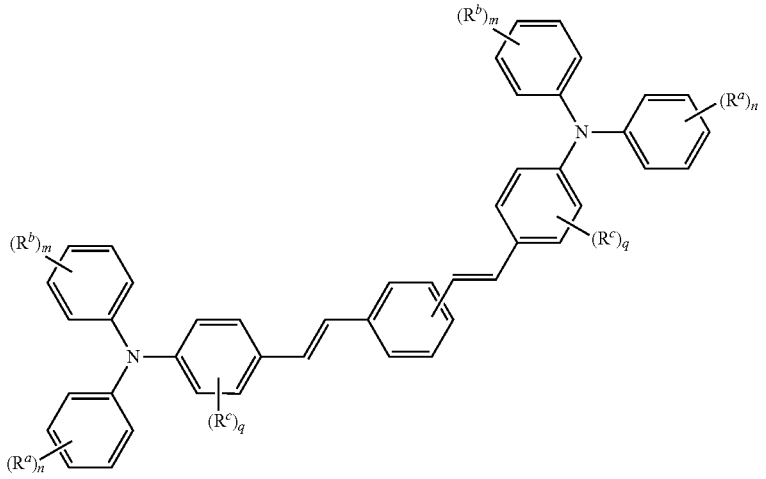

in general formula (4), $R^a$, $R^b$, and $R^c$ each represent, independently of one another, an alkyl group having a carbon number of at least 1 and no greater than 8, a phenyl group, or an alkoxy group having a carbon number of at least 1 and no greater than 8, q represents an integer of at least 0 and no greater than 4, when q represents an integer of at least 2 and no greater than 4, chemical groups $R^c$ bonded to the same phenylene group may be the same or different to one another, m and n each represent, independently of one another, an integer of at least 0 and no greater than 5, when m represents an integer of at least 2 and no greater than 5, chemical groups $R^b$ bonded to the same phenyl group may be the same or different to one another, and when n represents an integer of at least 2 and no greater than 5, chemical groups $R^a$ bonded to the same phenyl group may be the same or different to one another.

10. The electrophotographic photosensitive member according to claim 9, wherein b and c each represent 0, and in general formula (4), $R^a$ and $R^b$ each represent, independently of one another, an alkyl group having a carbon number of at least 1 and no greater than 4, m and n each represent, independently of one another, an integer of at least 0 and no greater than 2, and q represents 0.

11. The electrophotographic photosensitive member according to claim 9, wherein the charge transport material includes the compound represented by general formula (3), where in general formula (3), $Q^8$, $Q^{10}$, $Q^{11}$, $Q^{12}$, $Q^{13}$, $Q^{14}$ each represent, independently of one another, a hydrogen atom or an alkyl group having a carbon number of at least 1 and no greater than 4, and b and c each represent 0.

12. The electrophotographic photosensitive member according to claim 1, wherein the photosensitive layer includes:

a charge generating layer containing the charge generating material; and a charge transport layer containing the charge transport material and the binder resin, and the charge transport layer is a monolayer charge transport layer and is disposed as an outermost layer.

13. The electrophotographic photosensitive member according to claim 1, wherein s/(s+u) is at least 0.08 and no greater than 0.80 in general formula (1).

14. The electrophotographic photosensitive member according to claim 1, wherein s/(s+u) is 0.80 in general formula (1).

* * * * *